US012031786B1

(12) United States Patent
Drew et al.

(10) Patent No.: US 12,031,786 B1
(45) Date of Patent: Jul. 9, 2024

(54) AUTO PURGE SUPPRESSOR

(71) Applicant: Knight's Armament, LLC, Titusville, FL (US)

(72) Inventors: Joshua R. Drew, Orlando, FL (US); C. Reed Knight, Jr., Titusville, FL (US); Charles Christopher Hoffman, Satellite Beach, FL (US); Murphy S. Walden, Orlando, FL (US)

(73) Assignee: Knight's Armament, LLC, Titusville, FL (US)

( * ) Notice: Subject to any disclaimer, the term of this patent is extended or adjusted under 35 U.S.C. 154(b) by 97 days.

(21) Appl. No.: 17/936,938

(22) Filed: Sep. 30, 2022

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/32; F41A 21/34
USPC ..... 89/14.4
See application file for complete search history.

(56) References Cited

U.S. PATENT DOCUMENTS

| | | | | |
|---|---|---|---|---|
| 2,503,491 | A * | 4/1950 | Janz | F41A 21/30 89/14.4 |
| 8,167,084 | B1 | 5/2012 | Moore | |
| 8,671,818 | B1 | 3/2014 | Oliver | |
| 9,316,456 | B1 | 4/2016 | Oliver | |
| 9,347,727 | B1 * | 5/2016 | Cler | F41A 21/30 |
| 9,423,198 | B1 | 8/2016 | Oliver | |
| 10,228,210 | B2 | 3/2019 | Parker | |
| 10,337,819 | B1 | 7/2019 | Stark et al. | |
| 10,584,934 | B2 | 3/2020 | Lau | |
| 10,627,180 | B2 | 4/2020 | Lau | |
| 10,890,403 | B2 * | 1/2021 | Petersen | F42B 39/20 |
| 10,890,404 | B2 * | 1/2021 | Petersen | F41A 21/30 |
| 11,725,898 | B2 * | 8/2023 | Muceus | B22F 5/106 89/14.4 |
| 2010/0180759 | A1 * | 7/2010 | Petersen | F41A 21/30 89/14.4 |
| 2016/0003570 | A1 * | 1/2016 | Tonkin | F41A 21/04 89/14.4 |
| 2017/0307323 | A1 * | 10/2017 | Couvillion | F41A 21/36 |
| 2021/0199401 | A1 * | 7/2021 | Magee | F41A 21/30 |
| 2023/0115902 | A1 * | 4/2023 | Grob | F41A 21/30 89/14.4 |

(Continued)

FOREIGN PATENT DOCUMENTS

| | | | | |
|---|---|---|---|---|
| EP | 4317902 | A1 * | 2/2024 | F41A 21/30 |
| WO | WO-2022079358 | A1 * | 4/2022 | F41A 21/30 |

*Primary Examiner* — Samir Abdosh
(74) *Attorney, Agent, or Firm* — Woodard, Emhardt, Henry, Reeves & Wagner, LLP

(57) ABSTRACT

A suppressor for reducing muzzle flash during firing of a firearm. The suppressor includes an auto purge channel configured to direct gas to a distal end of the suppressor adjacent an exit point of a projectile. In one example, the auto purge channel enables gas to saturate an area of the suppressor in front of the projectile. For example, the auto purge channel directs gas to the distal end of the suppressor at a speed that is greater than a speed of the projectile. In another embodiment, the projectile travels through combustion gasses transferred by the auto purge channel to reduce muzzle flash. In yet another example, the auto purge channel runs parallel to a central bore of the suppressor.

19 Claims, 27 Drawing Sheets

(56) References Cited

U.S. PATENT DOCUMENTS

| | | | | |
|---|---|---|---|---|
| 2023/0221088 | A1* | 7/2023 | Olsen | F41A 21/30 89/14.4 |
| 2023/0314098 | A1* | 10/2023 | Miller | F41A 21/30 89/14.4 |

* cited by examiner

AUTO PURGE SUPPRESSOR

GOVERNMENT LICENSE RIGHTS

This invention was made with government support under contract numbers W15QKN1491001 and W15QKN1891008 awarded by U.S. Army Research, Development, and Engineering Command. The government has certain rights in the invention.

BACKGROUND

First-round pop (FRP) and/or a first-round fireball is a common occurrence with suppressors. As should be appreciated, reducing the size of the fireball and/or the decibel level of the FRP is advantageous for both civilian and military applications. For example, mitigating the fireball reduces the ability of enemies to track and/or locate snipers after a shot.

Thus, there is a need for improvement in this field.

SUMMARY

The system and techniques as described and illustrated herein concern a number of unique and inventive aspects. Some, but by no means all, of these unique aspects are summarized below.

A unique suppressor has been developed for use with firearms. Specifically, the suppressor is developed to reduce the first shot fireball that is common with suppressors. As should be appreciated, reducing the size of the fireball is advantageous for both civilian and military applications. For example, mitigating the fireball reduces the ability of enemies to track and/or locate snipers after a shot.

The suppressor includes an auto purge system to reduce the large fireball and/or muzzle flash that typically occurs when firing a first shot through a suppressor. This large fireball is generated as a result of stored oxygen within the suppressor mixing with the combustion gasses and excess powder from a shot. As a result, the mixture leads to a large fireball and louder than usual pop, often known as first round pop (FRP). However, subsequent shots fired within a short timeframe do not typically experience this effect.

The auto purge system works to mimic the second shot environment to reduce the fireball. This is accomplished by a gas bypass channel bored within the interior of the suppressor. The channel runs parallel with a central bore of the suppressor (e.g. in the direction of bullet travel). Additionally, the channel is located adjacent the mounting location of one or more baffles. Generally, after a shot, a suppressor slows combustion gasses by using the one or more baffles, which reduces the decibel level of the shot. However, with the auto purge suppressor, a small amount of combustion gas is directed via a funnel portion into the channel. This combustion gas is deposited in an area of the suppressor just before the bullet exit point. The deposited gas then expands to fill an area of the suppressor in front of the bullet. As this combustion gas includes carbon dioxide, the fireball is mitigated.

The channel is designed to output a predetermined amount of combustion gas into the suppressor. Similarly, the channel is designed such that the gas is delivered to an end of the suppressor just before the bullet travels through the end of the suppressor. Put differently, the movement speed of the gas through the channel is higher than the speed of the bullet. This configuration creates an area of gas with a high carbon dioxide content in front of the bullet, which reduces the possibility of a fireball. In some cases, the suppressor may be built for a predetermined round pressure. For example, the suppressor may be specially designed for high pressure or +P ammunition. As should be appreciated, modifying the size of the channel affects the speed at which the gas moves. For example, a larger channel will typically result in slower moving gas, whereas a smaller channel will result in faster moving gas. In another example, a restricting orifice is implemented adjacent the channel to slow gas flow. In one example, the suppressor may be a stacked baffle type suppressor. In another example, the suppressor may be a monocore type suppressor. In yet another example, the suppressor may be manufactured via 3D printing.

Aspect 1 generally concerns a system that includes a suppressor for reducing muzzle flash.

Aspect 2 generally concerns the system of any previous aspect in which the suppressor includes an auto purge channel.

Aspect 3 generally concerns the system of any previous aspect in which the auto purge channel directs gas to a distal end of the suppressor adjacent a bullet exit point of the suppressor.

Aspect 4 generally concerns the system of any previous aspect in which the auto purge channel enables gas to saturate an area of the suppressor in front of a bullet.

Aspect 5 generally concerns the system of any previous aspect in which the auto purge channel directs gas at a speed that is greater than a speed of the bullet.

Aspect 6 generally concerns the system of any previous aspect in which the auto purge channel is sized to emit a predetermined amount of gas.

Aspect 7 generally concerns the system of any previous aspect in which the bullet travels through the gas transferred by the auto purge channel.

Aspect 8 generally concerns the system of any previous aspect in which the gas is carbon dioxide gas generated by combustion from a shot.

Aspect 9 generally concerns the system of any previous aspect in which the suppressor includes a funnel portion configured to direct gas into the auto purge channel.

Aspect 10 generally concerns the system of any previous aspect in which the auto purge channel runs adjacent to one or more baffle mounting locations.

Aspect 11 generally concerns the system of any previous aspect in which the auto purge channel runs parallel to a central bore of the suppressor.

Aspect 12 generally concerns the system of any previous aspect in which the auto purge channel is configured to reduce first shot fireball when firing a weapon.

Aspect 13 generally concerns the system of any previous aspect in which the suppressor is a stacked baffle suppressor.

Aspect 14 generally concerns the system of any previous aspect in which the suppressor is a monocore suppressor.

Aspect 15 generally concerns a method of operating the system of any previous aspect.

Further forms, objects, features, aspects, benefits, advantages, and embodiments of the present invention will become apparent from a detailed description and drawings provided herewith.

DETAILED DESCRIPTION OF SELECTED EMBODIMENTS

Figure 1:
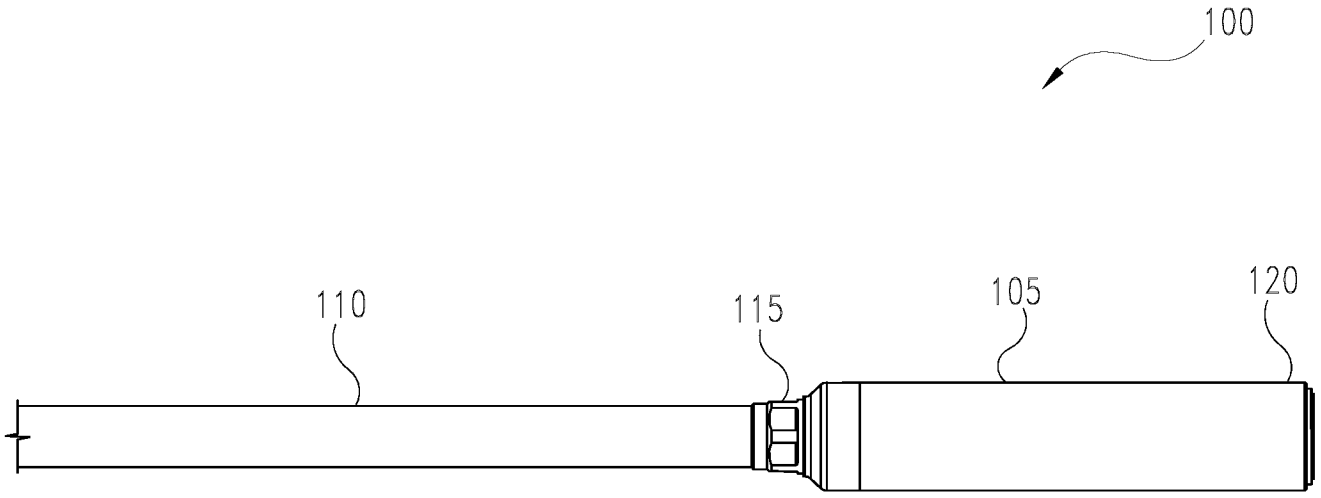
FIG. 1 is a diagrammatic view of a portion of a firearm.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will likely first appear in FIG. 1, an element identified by a "200" series reference numeral will likely first appear in FIG. 2, and so on.

FIG. 1 shows an example of a portion of a firearm 100 including a suppressor 105. In one example, the suppressor 105 is a stacked baffle type suppressor with removable baffles. In another example, the suppressor 105 is a monocore type suppressor with integral baffles. For example, the baffles are welded into the suppressor. The suppressor 105 is removably connected to a barrel 110 of the firearm 100 at a muzzle end 115 of the barrel 110. In one embodiment, the suppressor 105 includes an auto purge channel configured to direct combustion gases to a distal end 120 of the suppressor 105 ahead of a projectile. In one example, the combustion gases act as a flame suppressant to mitigate the large first-round flash typically experienced by shooters. As should be appreciated, mitigating the first-round flash mitigates temporary blindness and/or the ability to locate a shooter, especially in darkness.

Figure 2:
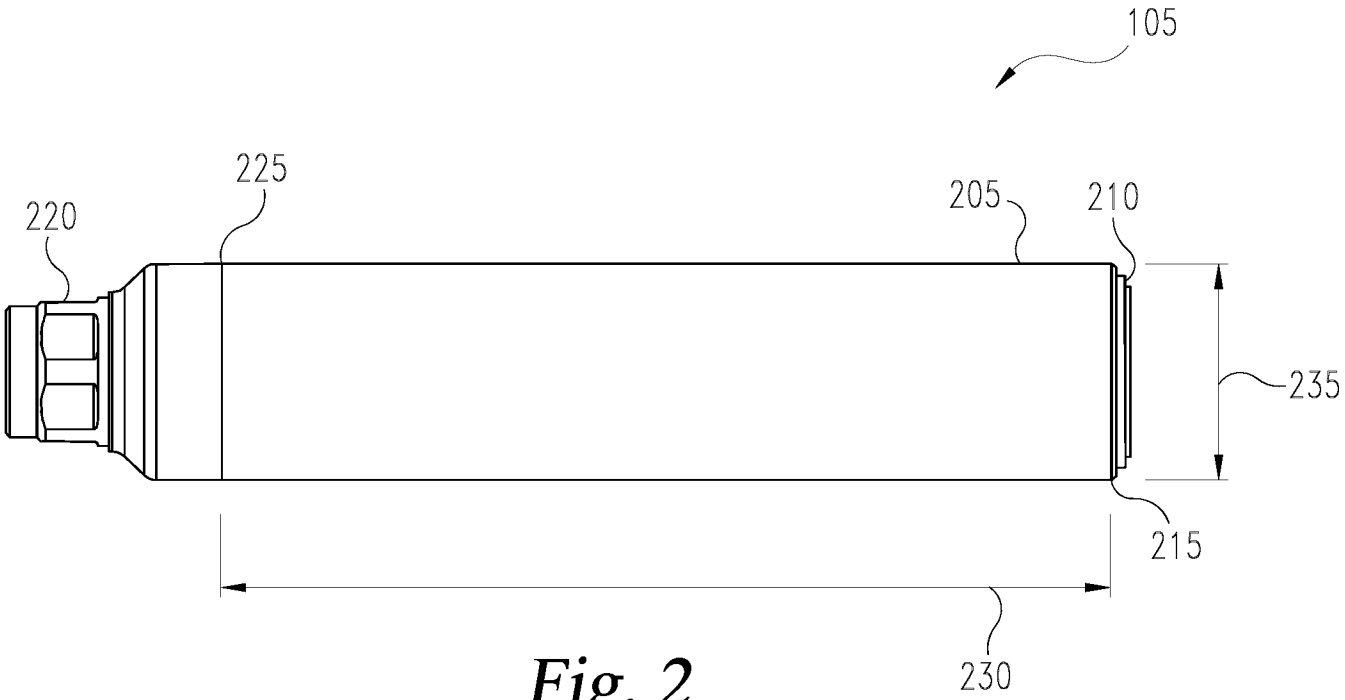
FIG. 2 is a side view of a suppressor.

FIG. 2 shows one embodiment of the suppressor 105 including an end cap 210 mounted to a first end 215 of the suppressor 105 and a mounting portion 220 mounted to a second end 225 of the suppressor 105. In one example, the body 205 defines an elongated cylindrical shape with a length 230 and a diameter 235. The length 230 of the body 205 is configured to correspond with the intended use of the suppressor 105. In some examples, the body 205 has a greater length 230 to further reduce noise and/or muzzle flash. In other examples, the body 205 has a smaller length 230 to facilitate close quarters combat. In most applications, the length 230 of the suppressor 105 is from 1-30 inches (2.54 cm to 76.2 cm). The diameter 235 of the suppressor 105 is further modified based on the intended use. For example, the diameter 235 is greater for higher pressure rounds and/or rounds that produce a greater volume of gas. In other examples, the diameter 235 is smaller for lower pressure rounds and/or rounds that produce a smaller volume of gas. In most applications, the diameter 235 is from 0.5-12.0 inches (1.27 cm to 30.48 cm).

Figure 3:
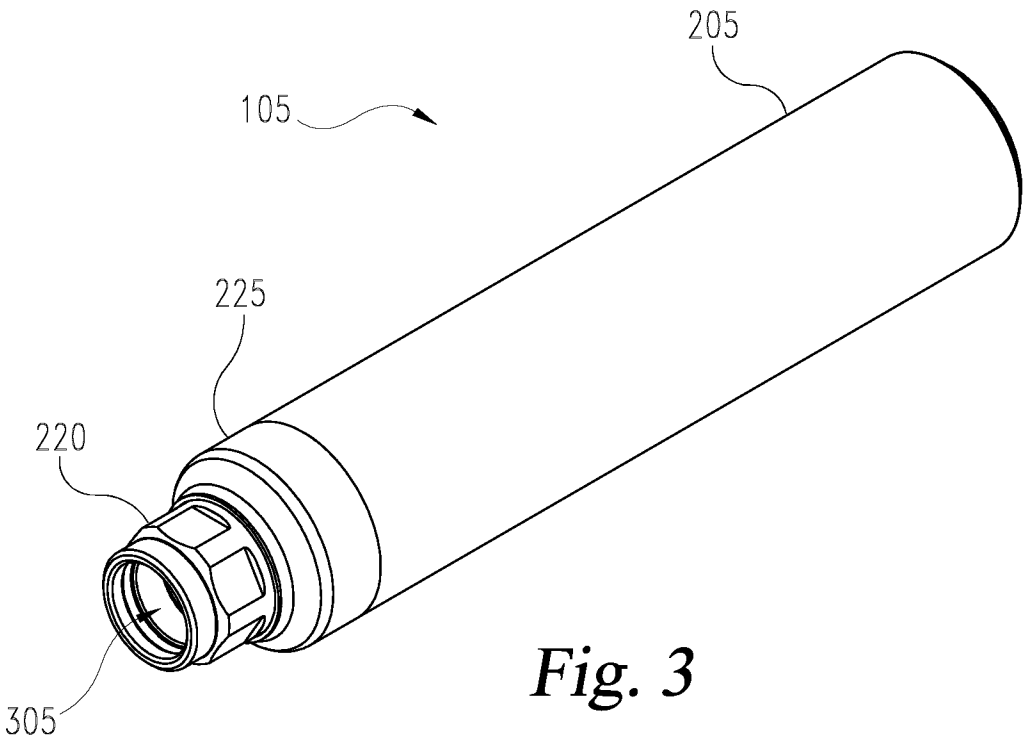
FIG. 3 is a rear perspective view of the suppressor of FIG. 2.

FIG. 3 shows a view of the mounting portion 220. The mounting portion 220 includes a receptacle 305 configured to receive the muzzle end 115 of the barrel 110. In some embodiments, the mounting portion 220 is configured to mount to the barrel 110 of the firearm 100 via one or more threads. In other embodiments, the mounting portion 220 is configured to mount to the barrel 110 via a quick-detach (QD) mechanism configured to enable rapid mounting and/or removal of the suppressor 105 from the firearm 100. Typically, the receptacle 305 is arranged such that the mounting portion 220 circumferentially surrounds a portion of the barrel 110.

Figure 4:
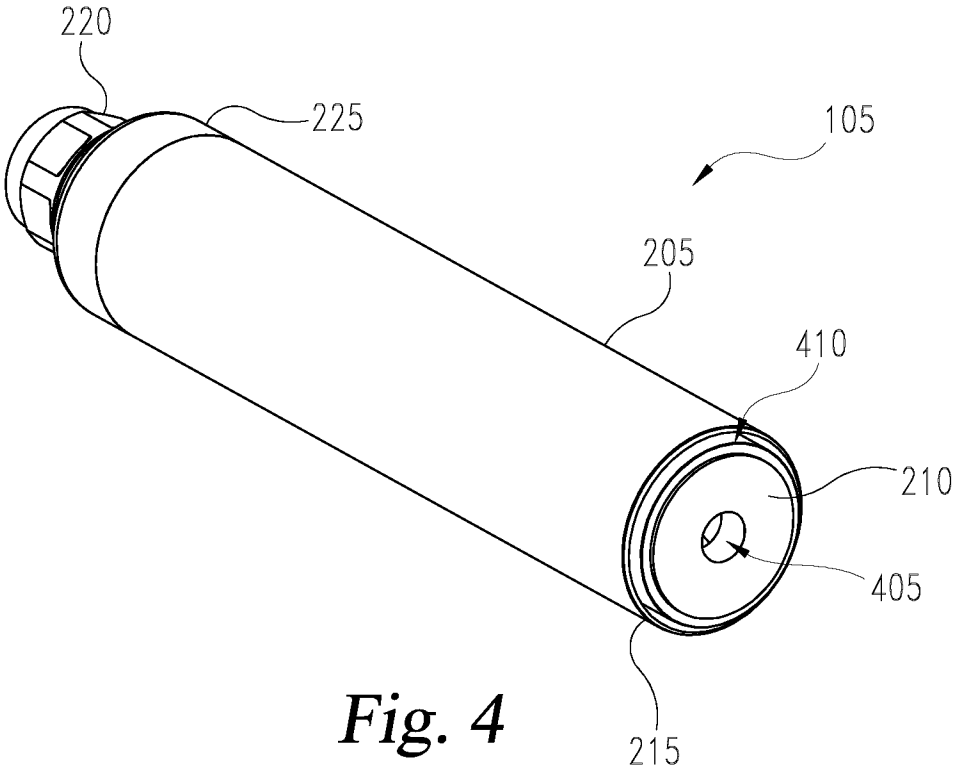
FIG. 4 is a front perspective view of the suppressor of FIG. 2.
Figure 5:
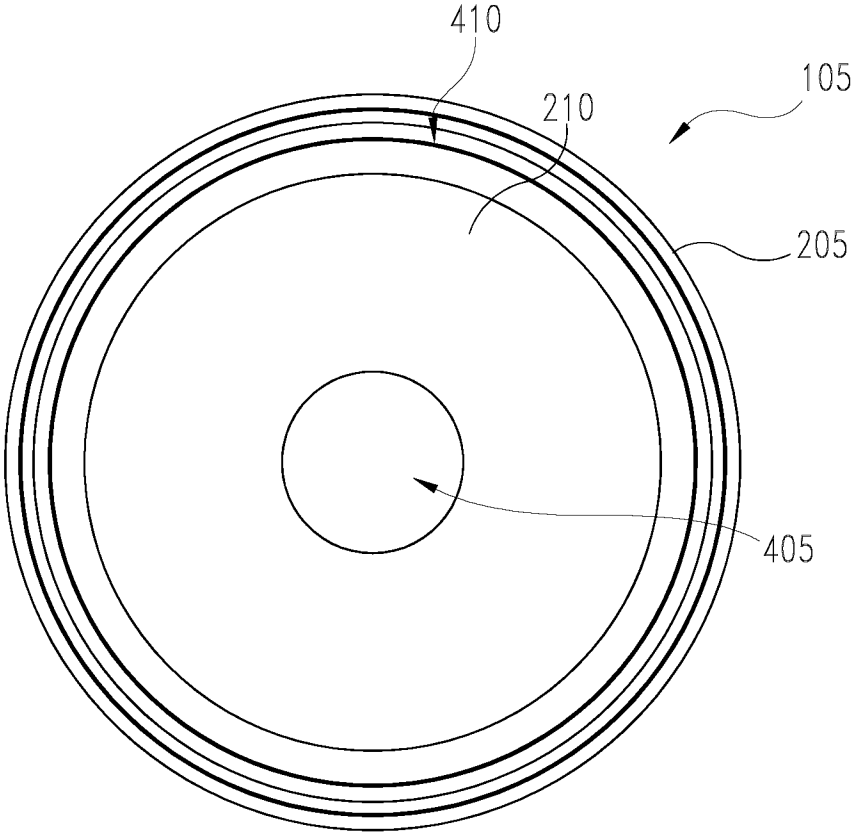
FIG. 5 is a front view of the suppressor of FIG. 2.

Turning to FIGS. 4 and 5 the suppressor 105 is shown to include a bore 405. The bore 405 is configured to extend through the length of the suppressor 105 such that the projectile travels from the barrel 110 through the suppressor 105 to the target. Typically, the bore 405 is designed such that a diameter of the bore 405 is configured to enable the passage of a similar and/or smaller diameter projectile. For example, a 9 mm projectile may travel through a bore 405 of greater than 9 mm. As should be appreciated, the suppressor 105 is configured to work will all calibers of firearm 100 by simply modifying the bore 405. The suppressor 105 is further shown to include an optional vent 410. The vent 410 is configured to enable the escape of excess combustion gasses. As should be appreciated, not all embodiments of the suppressor 105 include the vent 410. Typically, higher pressure and/or larger gas volume rounds and/or calibers include the vent 410 to enable the release of excess gas. However, smaller gas volume rounds and/or lower pressure rounds do not include the vent 410.

Figure 6:
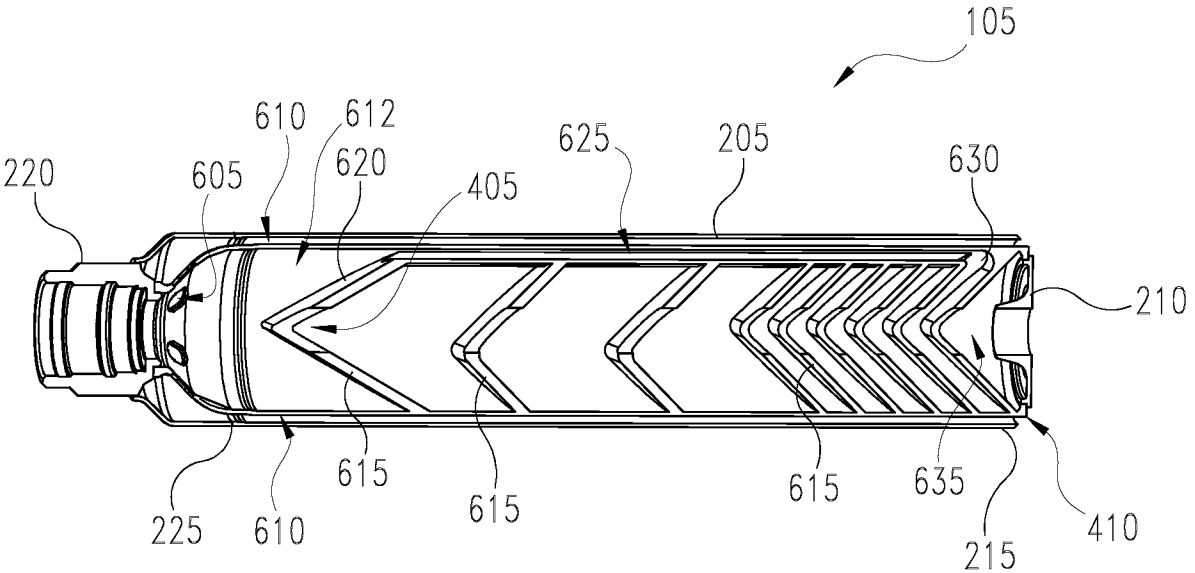
FIG. 6 is a cross-sectional view of the suppressor of FIG. 2.

FIG. 6 shows a cross-sectional view of the interior components of the suppressor 105. The suppressor 105 includes one or more apertures 605 configured to direct a portion of the combustion gases into a vent channel 610. The vent channel 610 is configured to guide the combustion gasses out of the vent 410 as described previously. The remainder of the combustion gasses are configured to expand into a cavity 635. The cavity 635 is configured to enable the combustion gasses to begin to expand. A funnel 612 is further configured to guide the combustion gas via a guide surface 620. The guide surface 620 is configured to divert some of the combustion gasses into a purge channel 625. One or more baffles 615 are further configured to slow the movement of combustion gasses through the suppressor 105 in to order enable excess powder to burn off, the gas to cool, and the gas to slow down in movement. Thus, a reduction in the noise level of the shot is achieved.

The purge channel 625 is configured to guide a portion of the combustion gasses to the length 230 of the suppressor 105. As should be appreciated, the reduced diameter of the purge channel 625 increases the velocity of the combustion gasses. The increase in velocity of the gasses enable the gas within the purge channel 625 to move at a higher speed than the fired projectile, thus the gas is able to reach the length 230 of the suppressor 105 prior to the projectile. The combustion gas continues through the purge channel 625 until reaching a guide wall 630, which directs the gas back into a guide wall 630 of the suppressor 105. As the projectile travels through the combustion gasses, the gas is forced out of the bore 405 prior to the projectile. As the combustion gasses include carbon monoxide (CO) and/or carbon dioxide (CO2), the combustion gasses act as a fire suppressant around the projectile, thus mitigating the muzzle flash. As should be appreciated, secondary flash typically occurs as a result of incompletely ignited powder and oxygen surrounding the suppressor. Thus, surrounding the suppressor with carbon monoxide/carbon dioxide instead of oxygen (O2) mitigates and/or prevents the ignition of the powder, lowering visible muzzle flash. In another example, an increase in carbon monoxide/carbon dioxide concentration at the distal end 120 of the suppressor 105 mitigated and/or prevents ignition of the powder, without surrounding the suppressor 105.

As can be seen, the purge channel 625 is arranged parallel to the bore 405 of the suppressor 105. Additionally, the purge channel 625 is arranged adjacent a mounting location of the baffles 615 to the body 205. In other embodiments, the purge channel 625 is positioned in other areas of the suppressor 105. For example, the purge channel 625 is positioned nearer to the bore 405 of the suppressor 105. Additionally, the diameter of the purge channel 625 is adjusted based on the velocity of the gas/projectile. For example, a smaller diameter purge channel 625 is used for higher velocity rounds and a larger diameter purge channel 625 is used for lower velocity rounds. In other embodiments, more than one purge channel 625 is used in order to direct a greater volume of combustion gas to the distal end 120 of the suppressor 105. For example, two (2), three (3), four (4), and/or more purge channels 625 are used.

Figure 7:
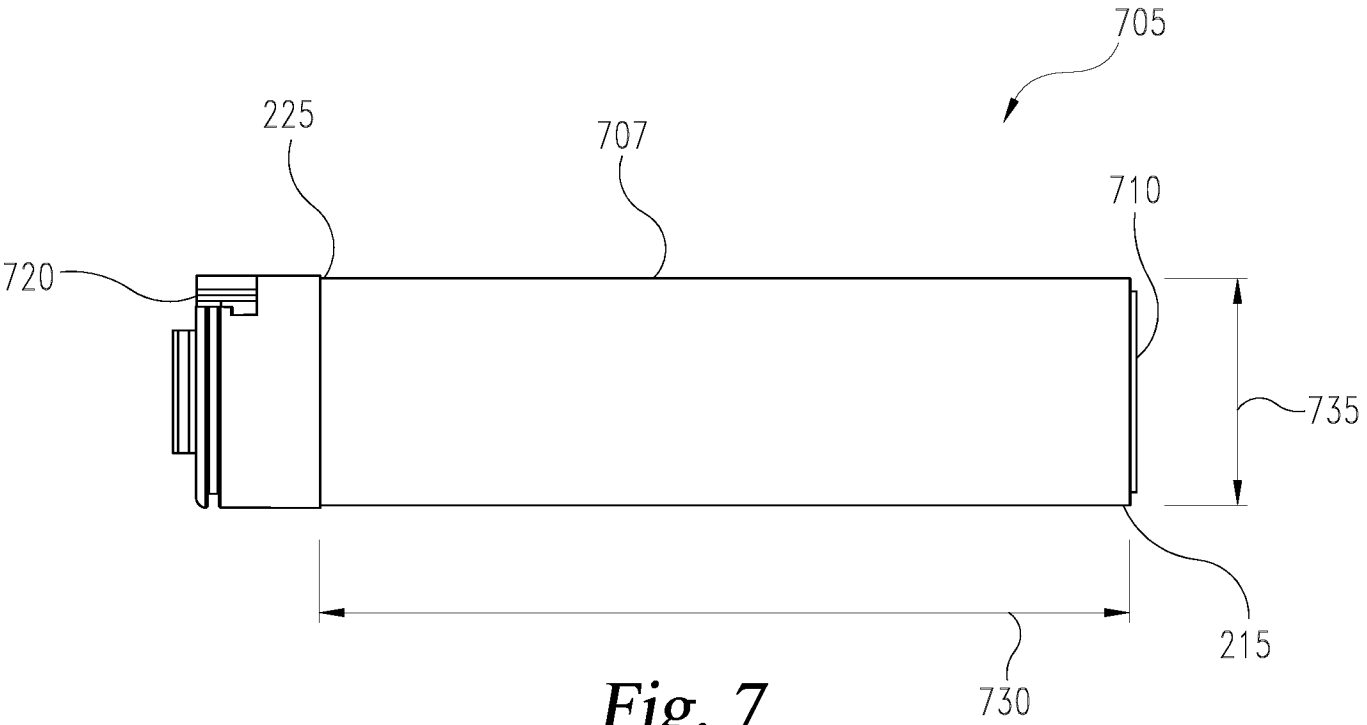
FIG. 7 is a side view of another embodiment of a suppressor.
Figure 8:
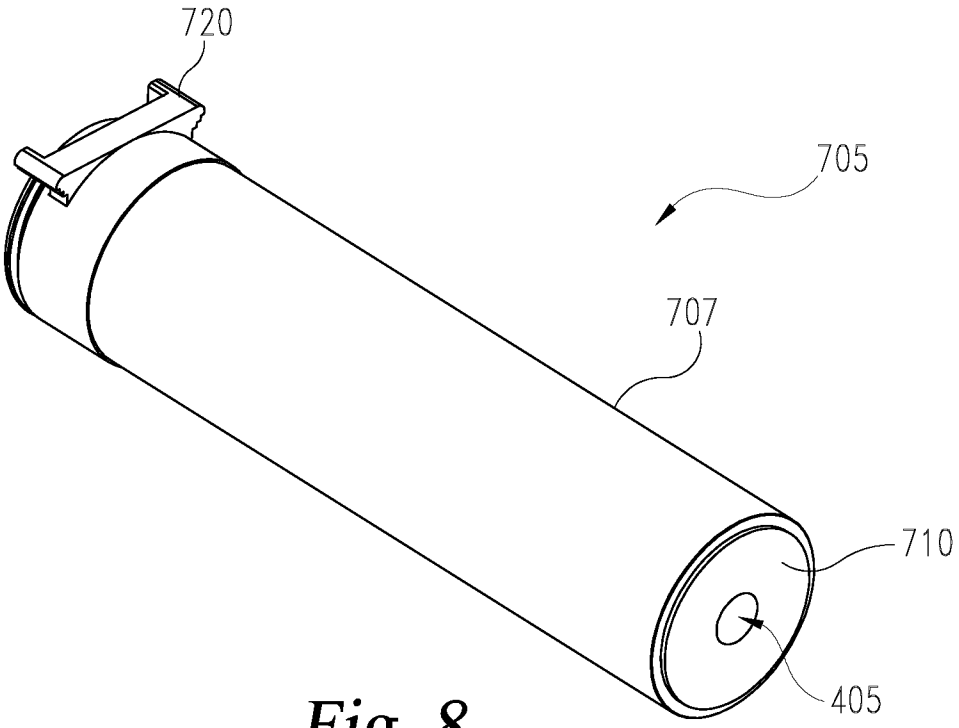
FIG. 8 is a front perspective view of the suppressor of FIG. 7.

FIGS. 7 and 8 show another variation of a suppressor 705. The suppressor 705 includes many of the same components and functions similarly to the suppressor 105 described previously in FIGS. 1-6. However, the suppressor 705 includes a body 707 with a different length 730 and/or diameter 735. For example, the body 707 is configured with a shorter length 730 for use with close quarters combat (CQC) weapons. Additionally, the suppressor 705 includes a modified end cap 710 and a quick detach (QD) mounting portion 720. For example, the end cap 710 of the suppressor 705 does not include a vent.

Figure 9:
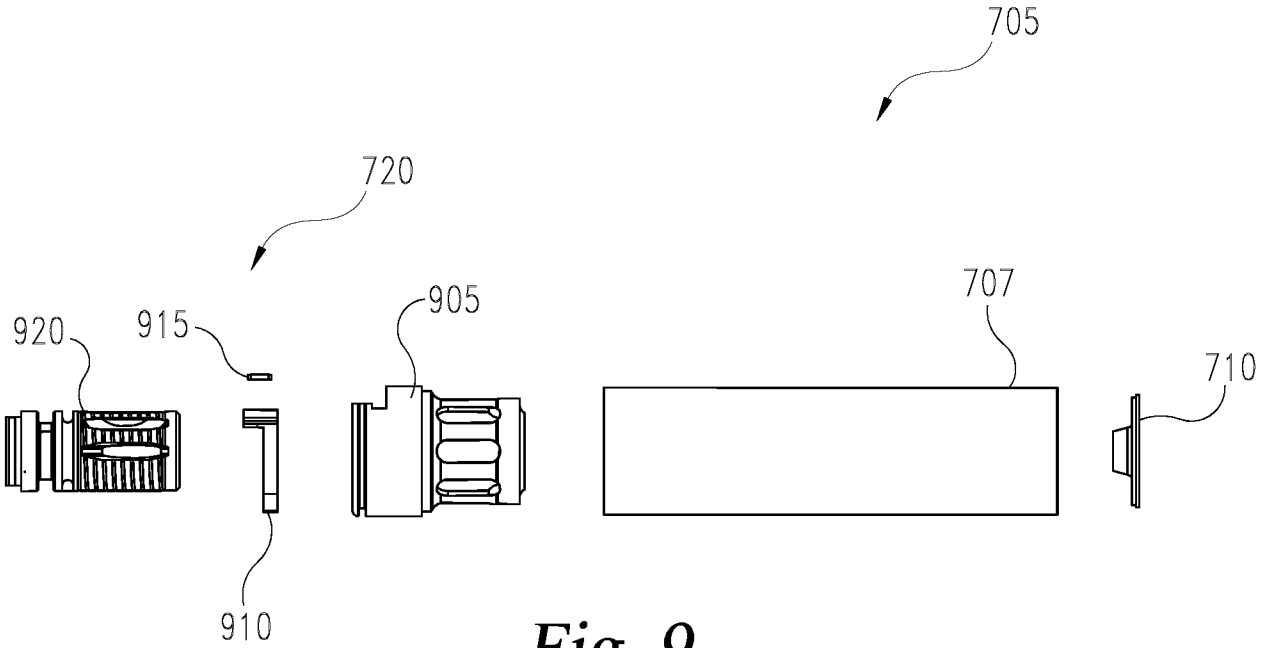
FIG. 9 is an exploded view of the suppressor of FIG. 7.

FIG. 9 shows an exploded view of the suppressor 705 depicting components of the QD mounting portion 720. As shown, the mounting portion 720 is configured to work with a preexisting muzzle device, such as a compensator, birdcage, flash hider, muzzle brake, and/or other muzzle device. For example, the mounting portion 720 is configured to clamp onto the muzzle device to secure the suppressor 705 to the firearm 100. As shown in FIG. 9, the mounting portion 720 includes a mounting plate 905, a latch 910, and a pin 915. The mounting plate 905 is configured to circumferentially surround the muzzle device, such as a compensator 920. The latch 910 and the pin 915 are configured to lock around and/or clamp around a portion of the compensator 920 to secure the suppressor 705 to the firearm 100. As should be appreciated, the QD mounting portion 720 allows for rapid mounting and/or removal of the suppressor 705 from the firearm 100.

Figure 10:
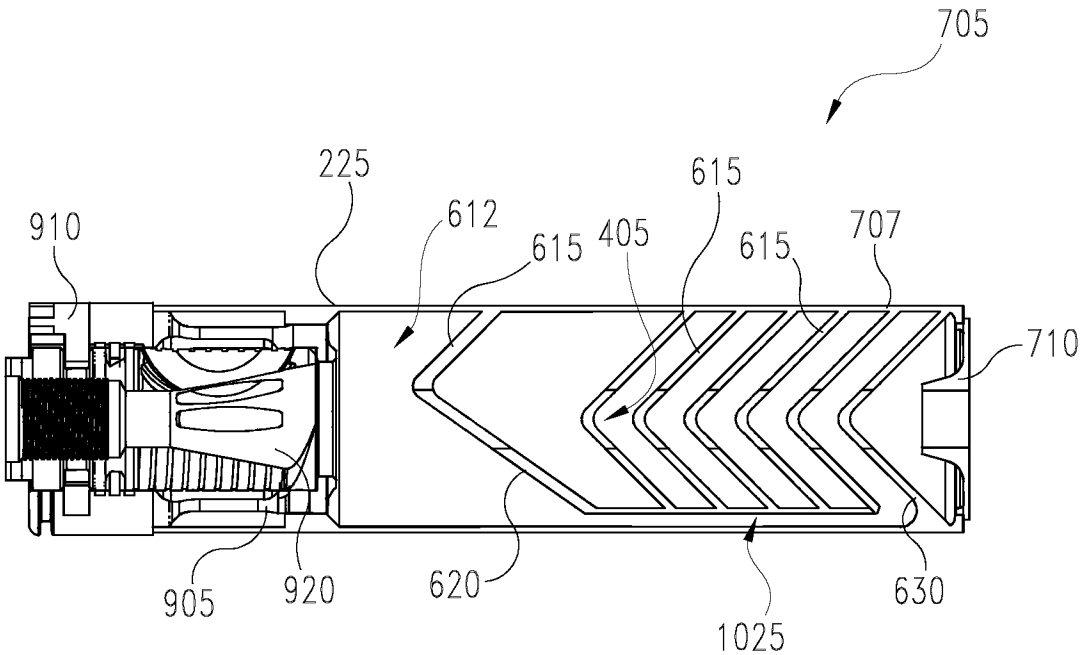
FIG. 10 is a cross-sectional view of the suppressor of FIG. 7.

FIG. 10 shows a cross-sectional view of the suppressor 705 including the compensator 920. The suppressor 705 includes many of the same components and is configured to function similarly to the suppressor 105 described previously in FIG. 6. However, the suppressor 705 includes a different diameter purge channel 1025. As should be appreciated, the modified length 730 of the body 707 necessitates a corresponding modification in the diameter of the purge channel 1025. For example, the diameter of the purge channel 1025 is increased in order to move combustion gas to the distal end of the suppressor 705 prior to arrival of the projectile.

Figure 11:
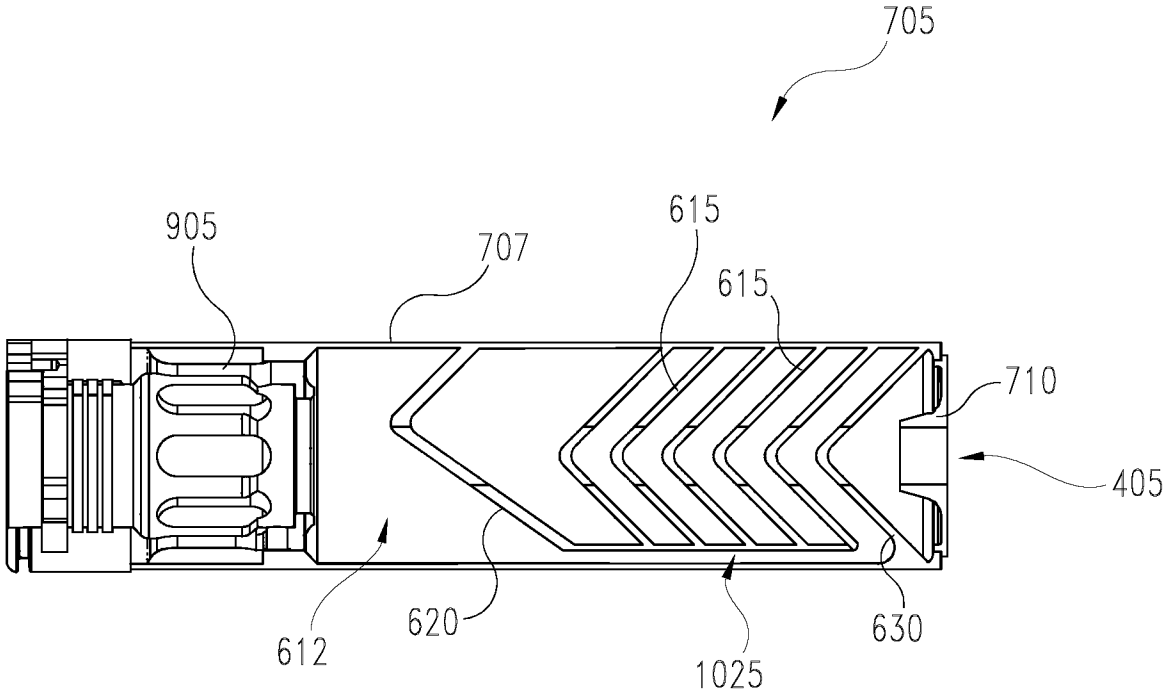
FIG. 11 is a cross-sectional view of the suppressor of FIG. 7 without a compensator.

FIG. 11 shows a cross-sectional view of the suppressor 705 without the compensator 920. As should be appreciated, the suppressor 705 can be used with and/or without the compensator 920. Thus, the suppressor 705 can directly mount to the firearm 100 without an existing muzzle device. In another example, the mounting portion 720 is exchanged for the mounting portion 220 based on the intended usage.

Figure 12:
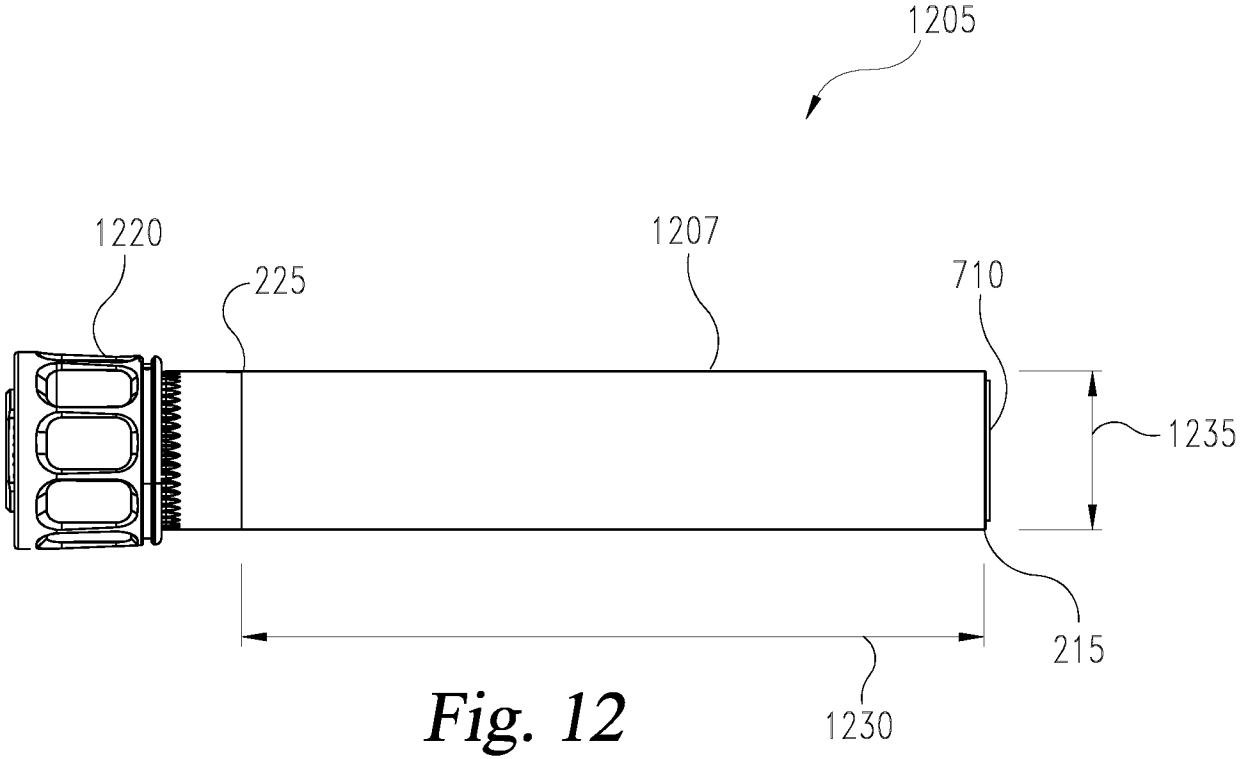
FIG. 12 is a side view of yet another embodiment of a suppressor.
Figure 13:
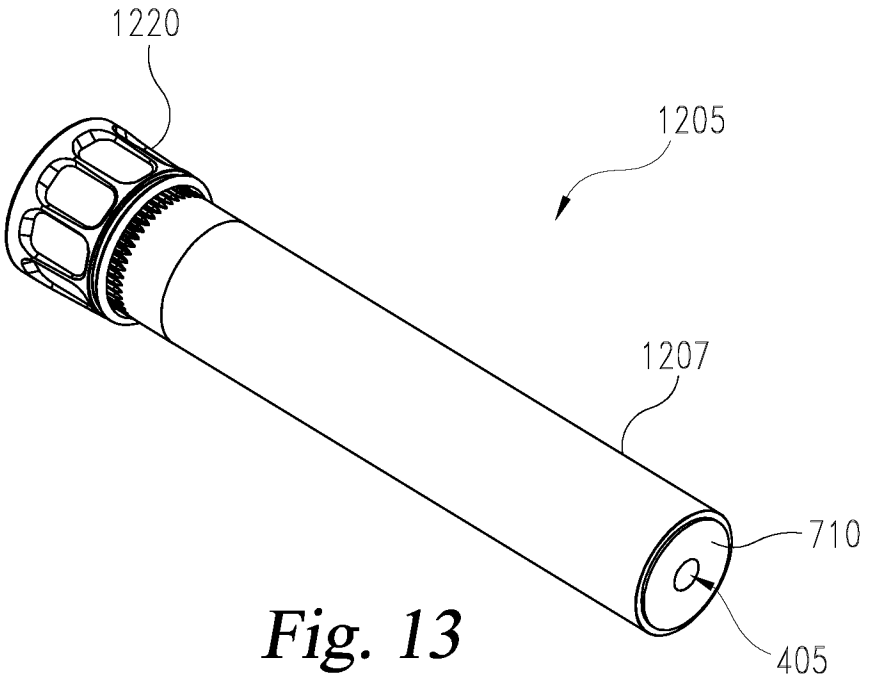
FIG. 13 is a front perspective view of the suppressor of FIG. 12.

FIGS. 12 and 13 show another variation of a suppressor 1205. The suppressor 1205 includes many of the same components and functions similarly to the suppressor 105 and suppressor 705 described previously in FIGS. 1-11. However, the suppressor 1205 includes a body 1207 with a different length 1230 and/or diameter 1235. For example, the body 1207 is configured with a longer length 1230 for use with larger caliber weapons and/or high-pressure rounds. Additionally, the suppressor 1205 includes another version of a QD mounting portion 1220.

Figure 14:
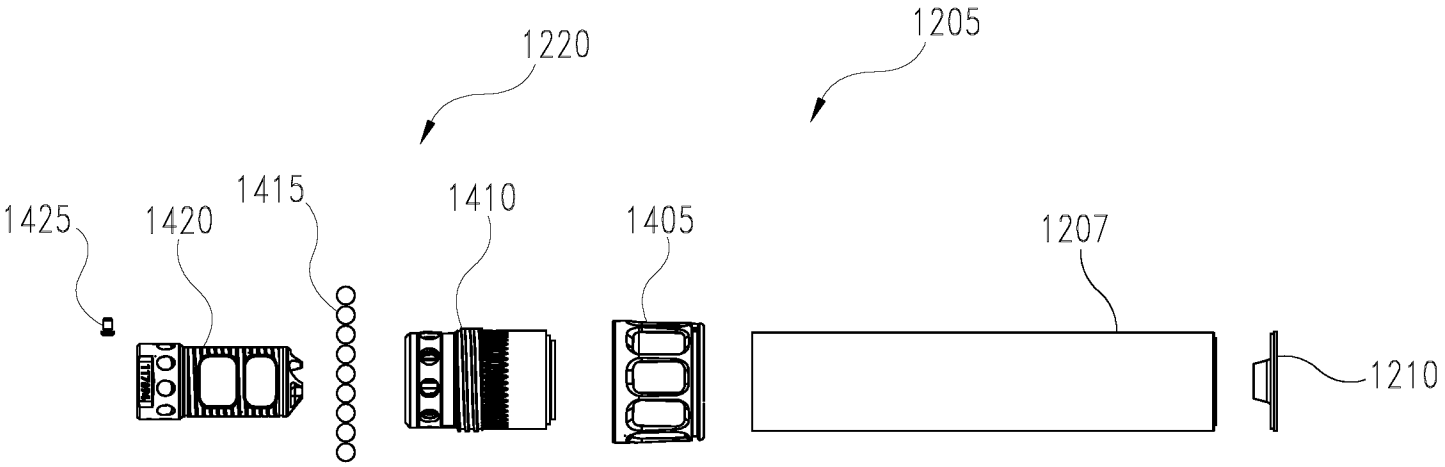
FIG. 14 is an exploded view of the suppressor of FIG. 12.
Figure 15:
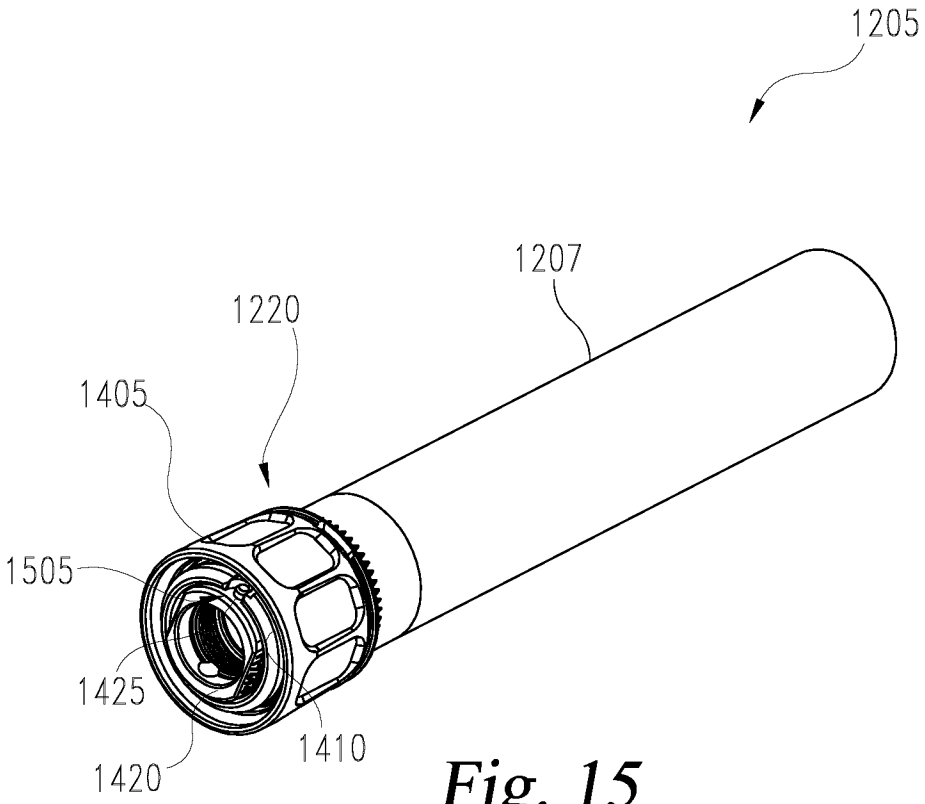
FIG. 15 is a rear perspective view of the suppressor of FIG. 12.

FIG. 14 shows an exploded view of the suppressor 1205 depicting components of the QD mounting portion 1220. As shown, the mounting portion 1220 is configured to work with a preexisting muzzle device, such as a compensator, birdcage, flash hider, muzzle brake, and/or other muzzle device. For example, the mounting portion 1220 is configured to clamp onto the muzzle device to secure the suppressor 1205 to the firearm 100. As shown in FIG. 14, the mounting portion 1220 includes a nut 1405, a support 1410, and one or more bearings 1415. The nut 1405 is configured to circumferentially surround and threadedly interact with the support 1410. For example, as the nut 1405 is rotated clockwise, the nut 1405 compresses the bearings 1415 within the support 1410 to secure a muzzle device, such as a flash hider 1420 to the suppressor 1205. In some embodiments, the flash hider 1420 includes a post 1425 configured to lock into a cutout 1505 (shown in FIG. 15). The nut 1405 is then tighten to secure the suppressor 1205 to the firearm 100. As should be appreciated, the QD mounting portion 1220 allows for rapid mounting and/or removal of the suppressor 1205 from the firearm 100.

Figure 16:
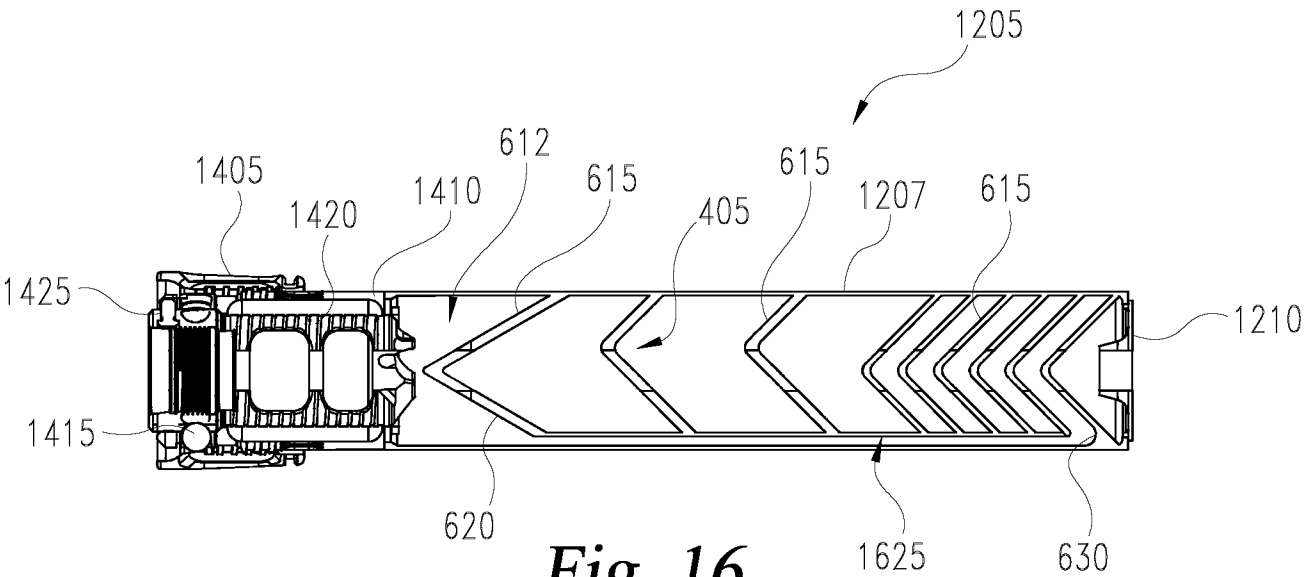
FIG. 16 is a cross-sectional view of the suppressor of FIG. 12.

FIG. 16 shows a cross-sectional view of the suppressor 1205 including the flash hider 1420. The suppressor 1205 includes many of the same components and is configured to function similarly to the suppressor 105 and suppressor 705 described previously in FIGS. 6 and 10. However, the suppressor 1205 includes a different diameter purge channel 1625. As should be appreciated, the modified length 1230 of the body 1207 necessitates a corresponding modification in the diameter of the purge channel 1625. For example, the diameter of the purge channel 1625 is decreased in order to move combustion gas to the distal end of the suppressor 1205 prior to arrival of the projectile.

Figure 17:
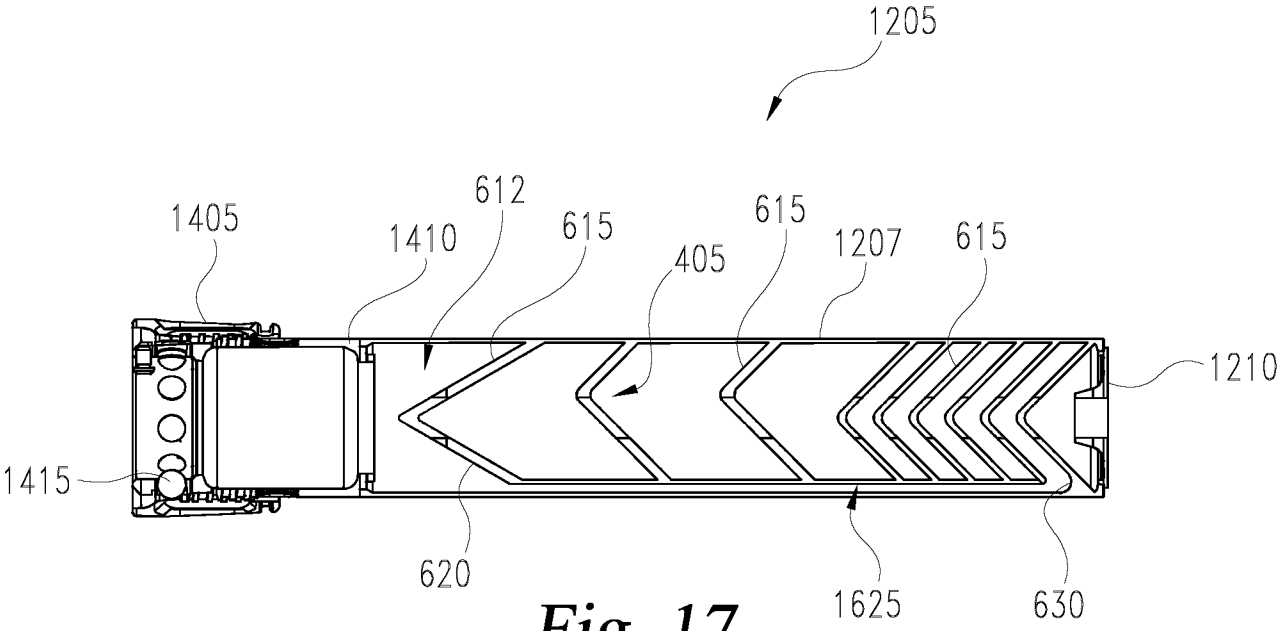
FIG. 17 is a cross-sectional view of the suppressor of FIG. 12 without a flash hider.

FIG. 17 shows a cross-sectional view of the suppressor 1205 without the flash hider 1420. As should be appreciated, the suppressor 1205 can be used with and/or without the flash hider 1420. Thus, the suppressor 1205 can directly mount to the firearm 100 without an existing muzzle device. In another example, the flash hider 1420 is exchanged for the mounting portion 220 and/or the mounting portion 720 based on the intended usage.

Figure 18:
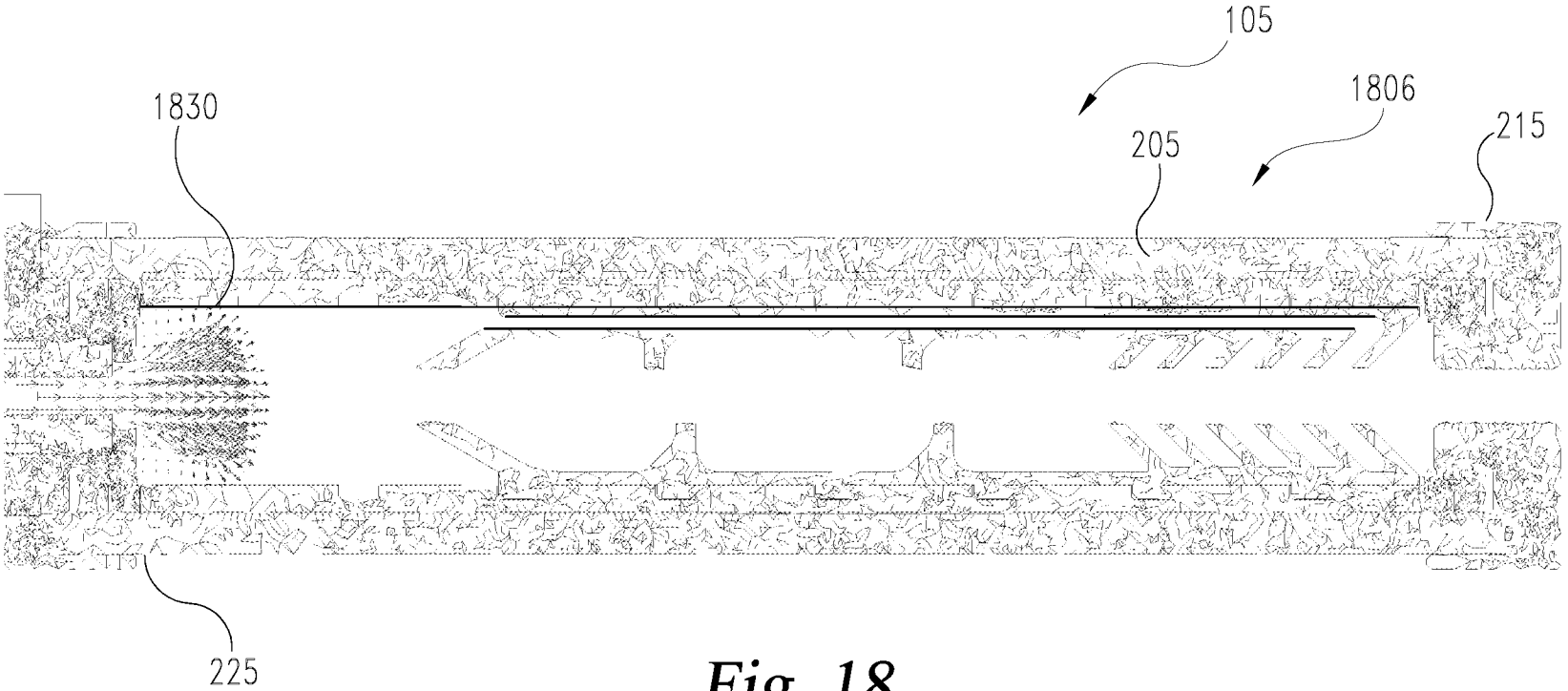
FIG. 18 is a diagrammatic view of the suppressor during a stage of the firing process.
Figure 19:
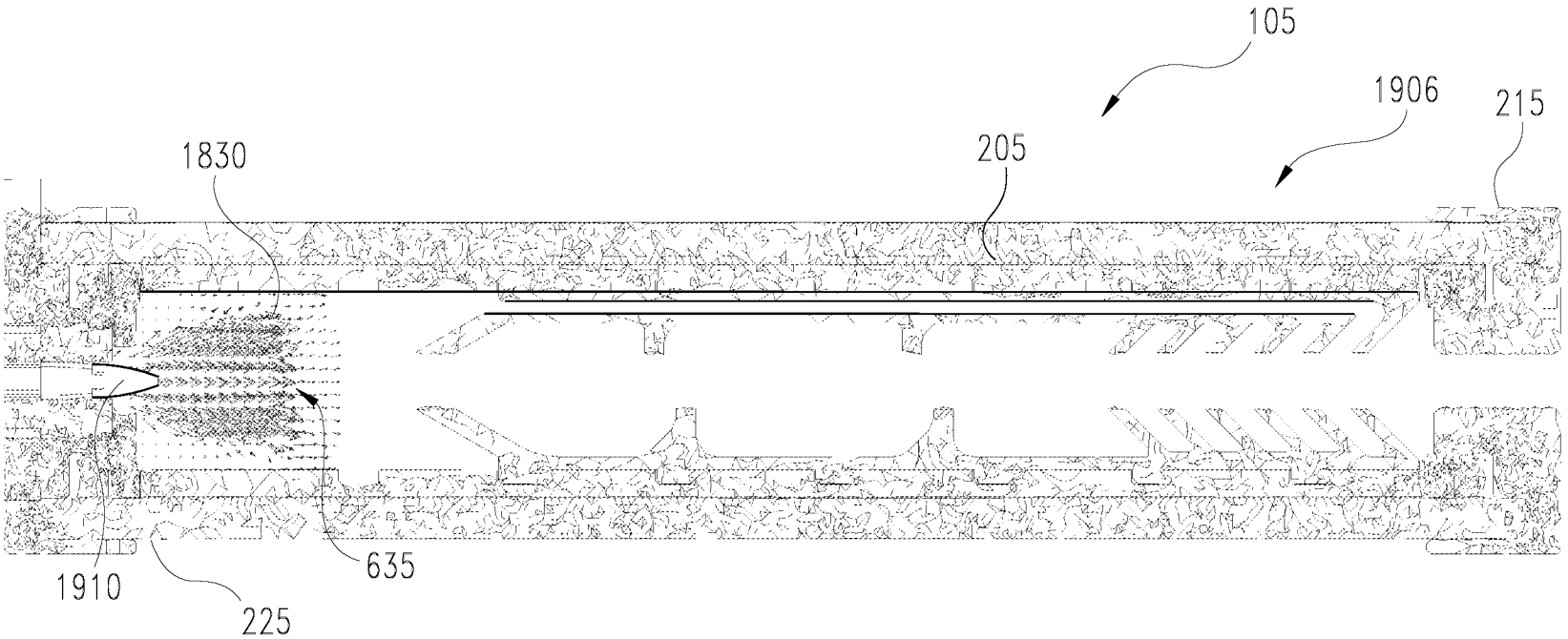
FIG. 19 is a diagrammatic view of the suppressor of FIG. 1 during another stage of the firing process.
Figure 20:
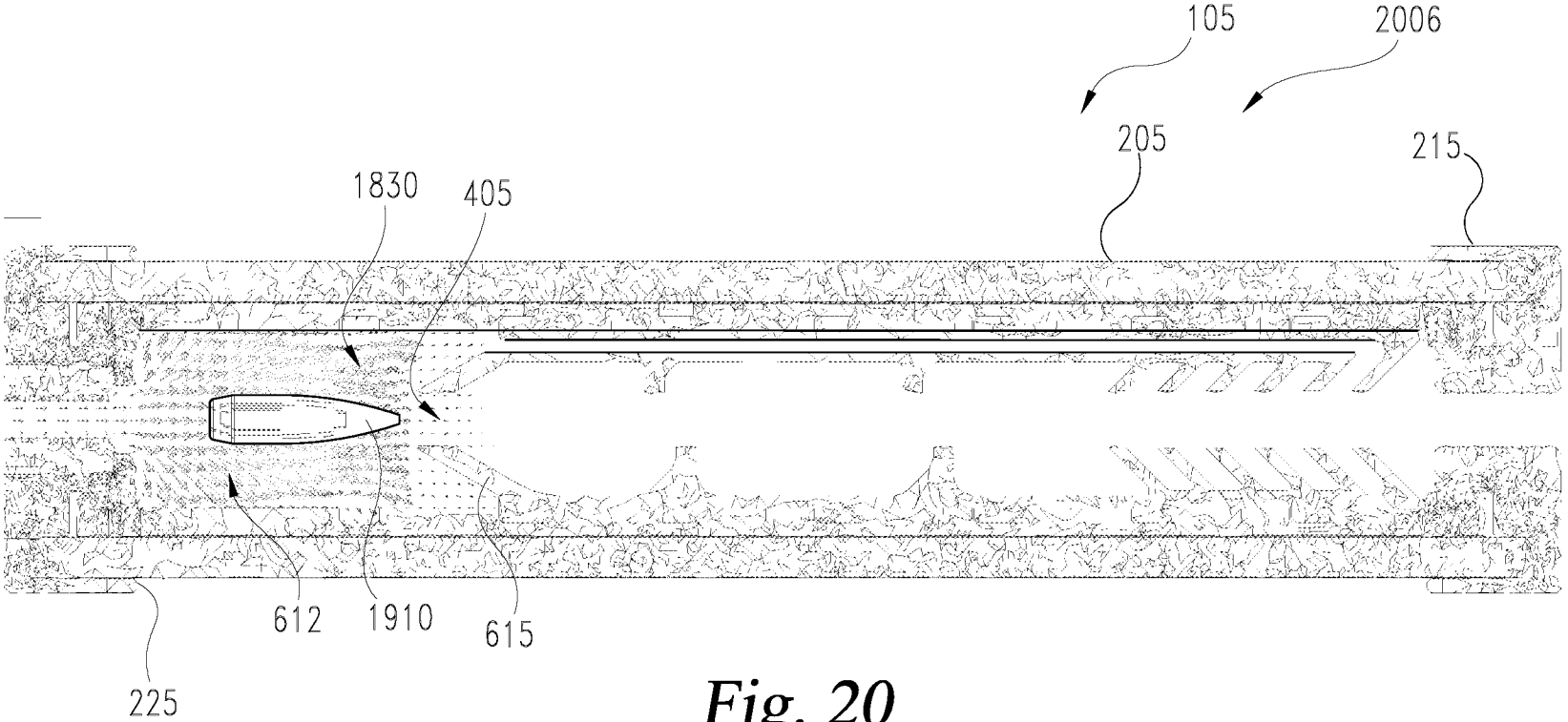
FIG. 20 is a diagrammatic view of the suppressor of FIG. 1 during another stage of the firing process.

FIGS. 18-27 show an example of an auto purge process of the suppressor 105. As shown in FIG. 18, at stage 1806, following the shot combustion gas 1830 begins to flow into the second end 225 of the suppressor 105. FIG. 19 depicts stage 1906 as a projectile 1910 leaves the barrel 110 and enters the second end 225 of the suppressor 105. The combustion gas 1830 continues to expand into the cavity 635 of the suppressor 105. At stage 2006, shown in FIG. 20, the projectile 1910 continues to move along the bore 405 towards the first end 215 of the suppressor 105. The combustion gas 1830 begins to fill the funnel 612 of the suppressor 105 and is slowed and/or dispersed via the baffles 615.

Figure 21:
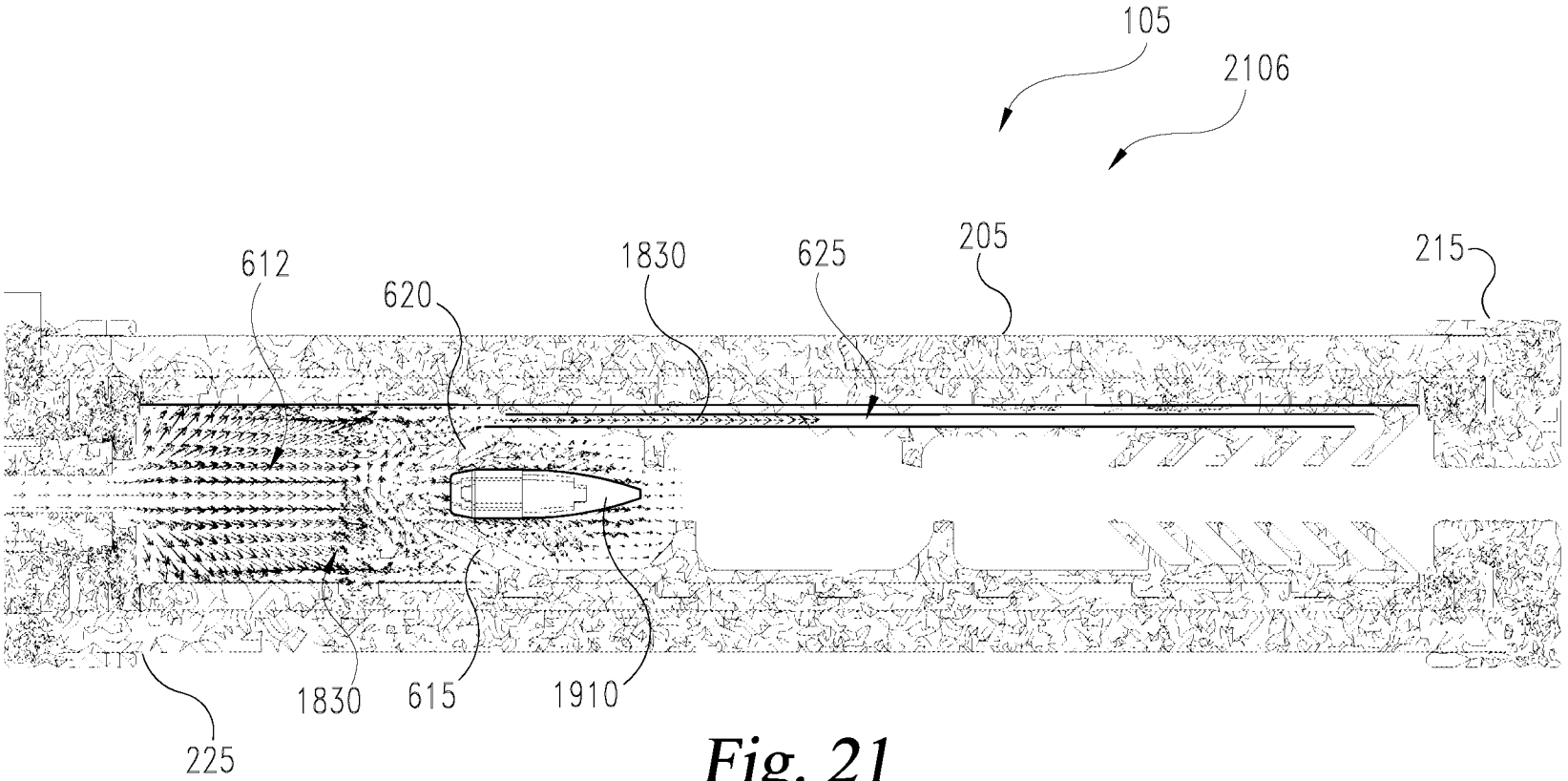
FIG. 21 is a diagrammatic view of the suppressor of FIG. 1 during another stage of the firing process.
Figure 22:
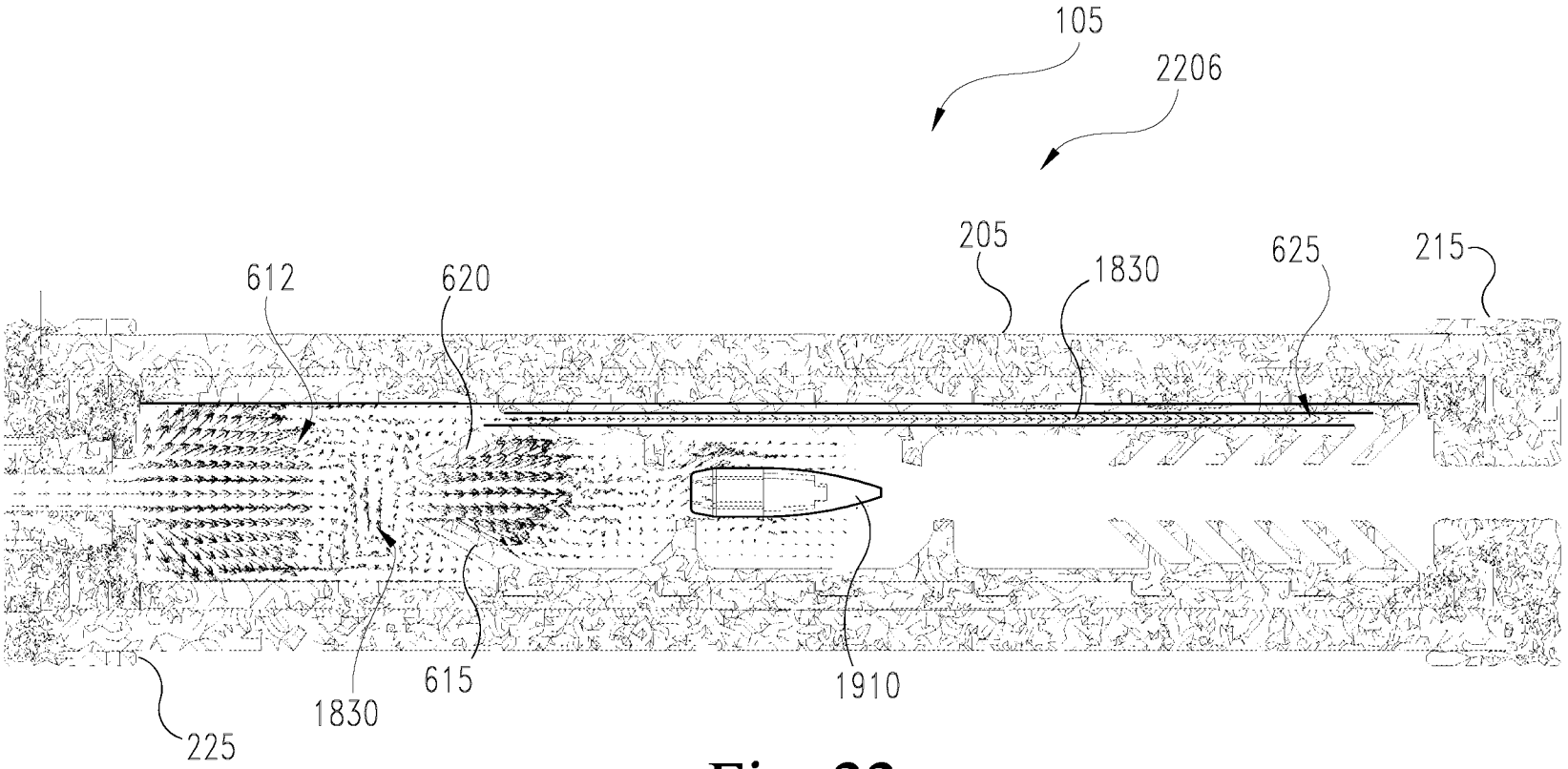
FIG. 22 is a diagrammatic view of the suppressor of FIG. 1 during another stage of the firing process.

In FIG. 21, at stage 2106, a portion of the combustion gas 1830 is guided into the purge channel 625 via the guide surface 620. As mentioned previously, the smaller area of the purge channel 625 increases the velocity of the combustion gas 1830 to a greater velocity than the projectile 1910. Thus, the combustion gas 1830 in the purge channel 625 begins to outpace the projectile 1910. Additionally, as the combustion gas 1830 moves through the purge channel 625 oxygen held within the purge channel 625 is displaced via the combustion gas 1830 to simulate an after shot environment. FIG. 22 shows stage 2206 in which the projectile 1910 begins to outpace the combustion gas 1830 within the cavity 635, but the combustion gas 1830 within the purge channel 625 reaches the distal end 120 of the suppressor 105.

Figure 23:
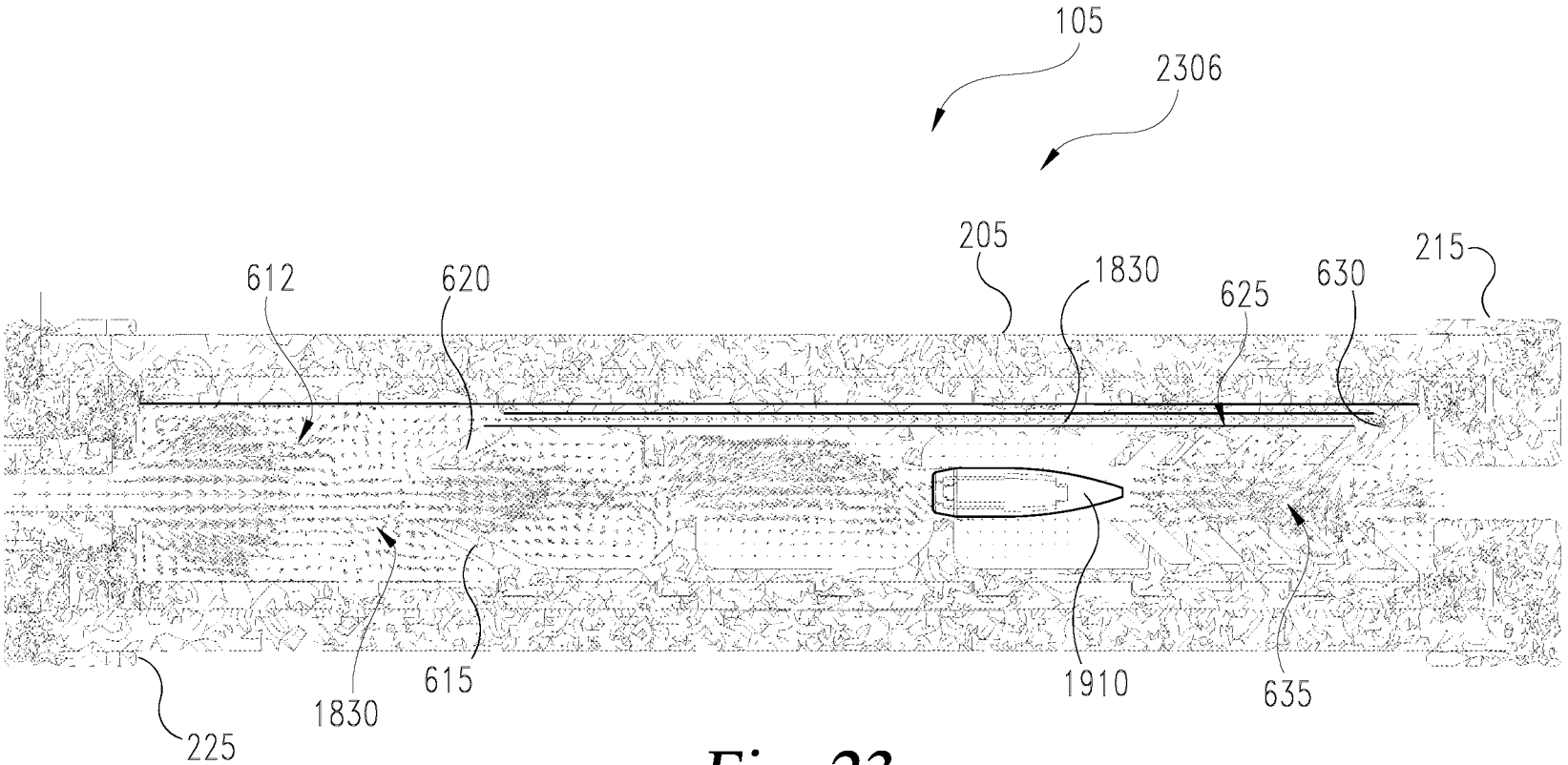
FIG. 23 is a diagrammatic view of the suppressor of FIG. 1 during another stage of the firing process.
Figure 24:
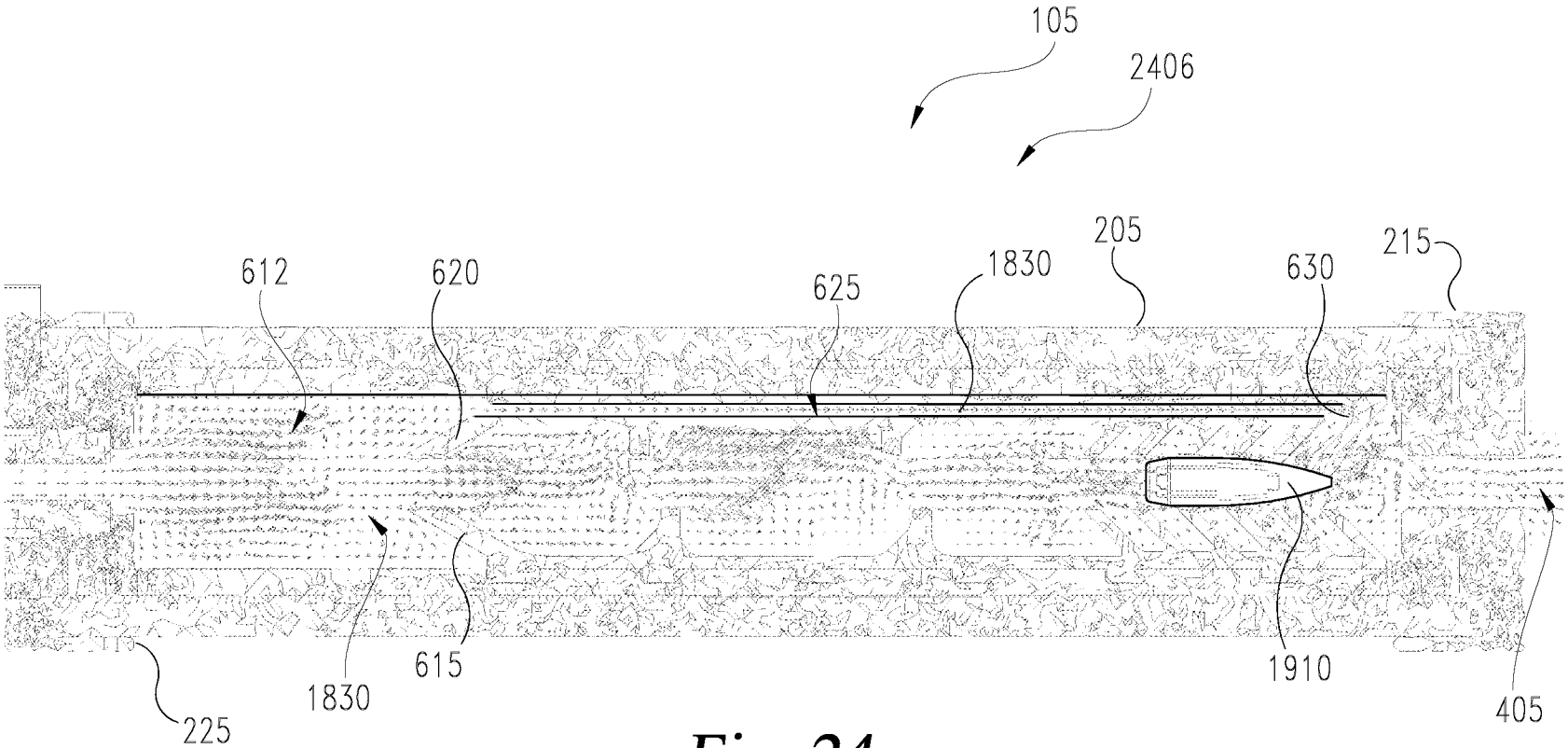
FIG. 24 is a diagrammatic view of the suppressor of FIG. 1 during another stage of the firing process.
Figure 25:
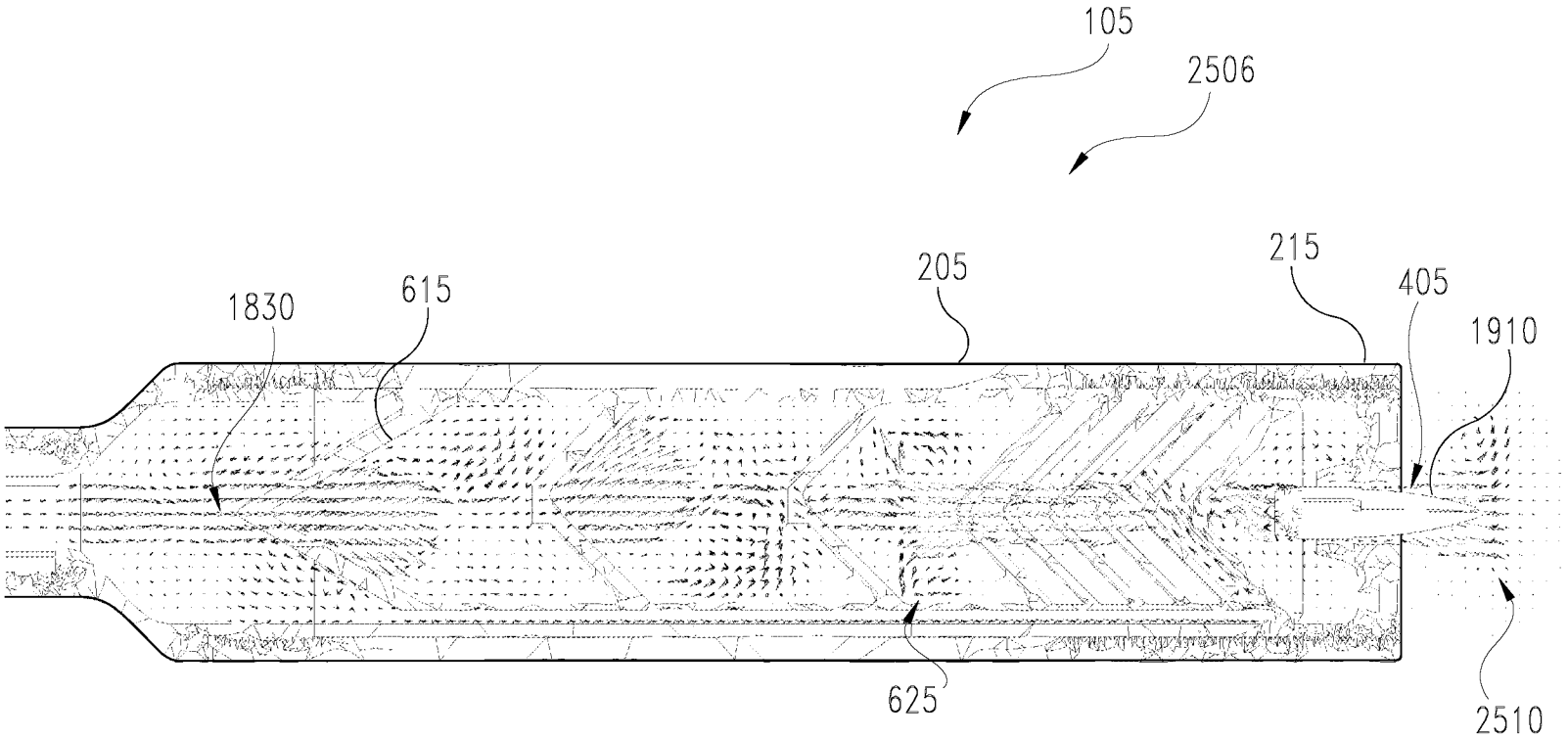
FIG. 25 is a diagrammatic view of the suppressor of FIG. 1 during another stage of the firing process.

In FIG. 23, at stage 2306, the combustion gas 1830 within the purge channel 625 is guided via the guide wall 630 into the cavity 635 of the distal end 120 of the suppressor 105, ahead of the projectile 1910. As should be appreciated, instead of flammable oxygen, the combustion gas 1830 includes a fire retardant in the form of carbon monoxide and/or carbon dioxide. As shown in FIG. 24 at stage 2406, the projectile 1910 begins to move through the combustion gas 1830 at the distal end 120 of the suppressor 105. The projectile 1910 displaces and/or forces out the carbon monoxide and/or carbon dioxide heavy combustion gas 1830 ahead of the projectile 1910. As shown in FIG. 25 at stage 2506, the projectile 1910 begins to exit the first end 215 of the suppressor 105 via the bore 405. The combustion gas 1830, forced out of the suppressor 105 ahead of the projectile 1910 begins to disperse forming a fire-retardant zone 2510, which displaces the flammable oxygen and replicates the environment after a shot.

Figure 26:
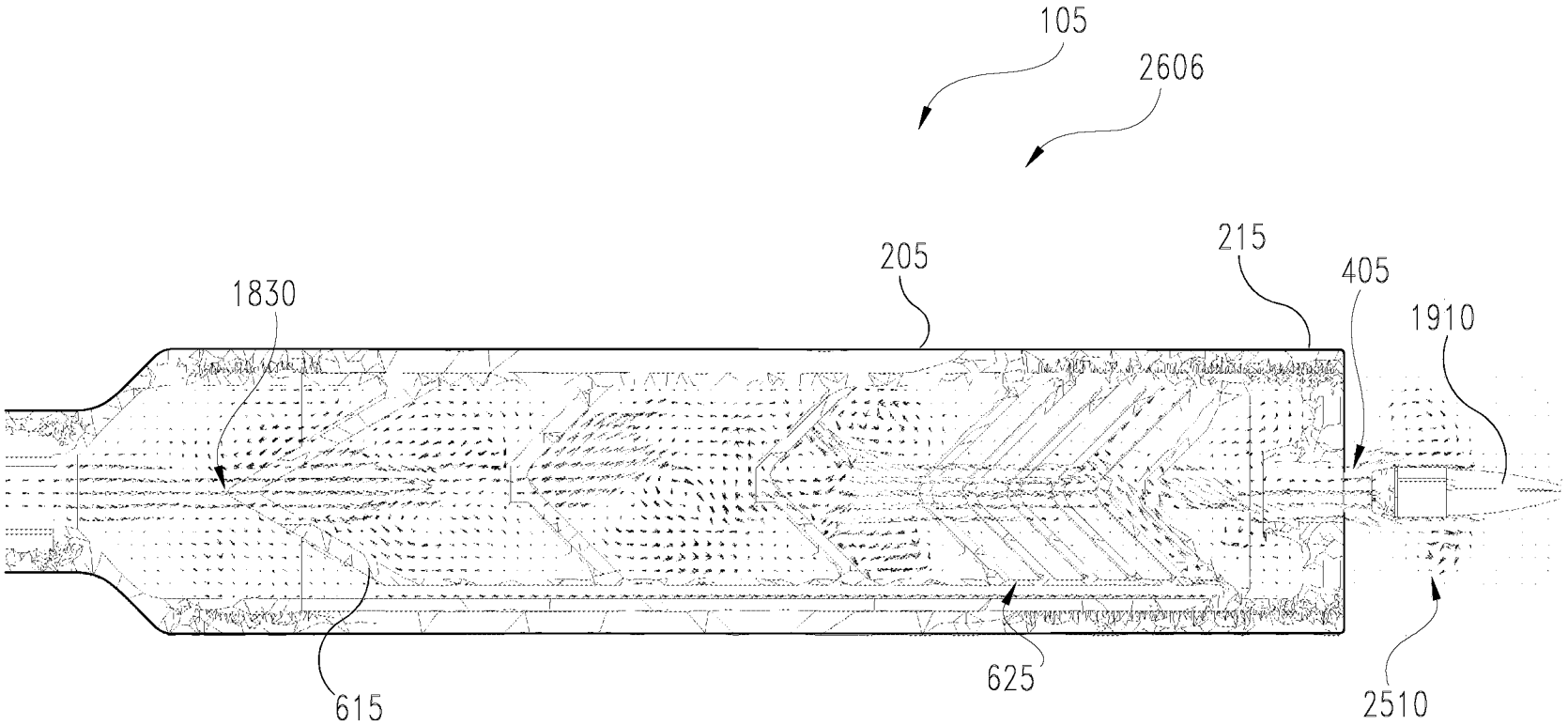
FIG. 26 is a diagrammatic view of the suppressor of FIG. 1 during another stage of the firing process.
Figure 27:
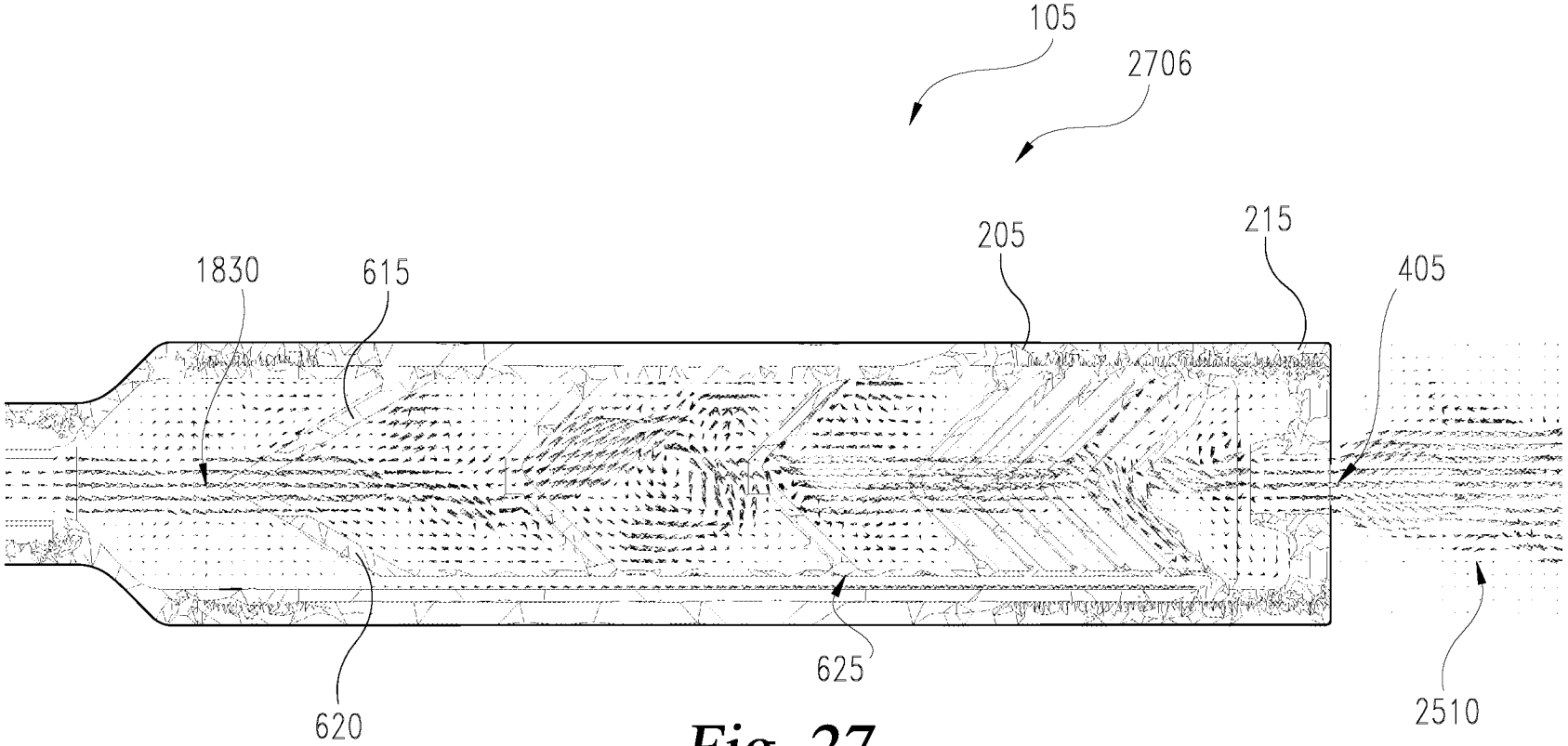
FIG. 27 is a diagrammatic view of the suppressor of FIG. 1 during another stage of the firing process.

In FIG. 26 at stage 2606, the projectile 1910 fully exits the suppressor 105 and continues onto the target. The fire-retardant zone 2510 maintains a carbon monoxide and/or carbon dioxide heavy area surrounding the first end 215 of the suppressor 105, thus preventing unburnt powder from interacting with oxygen to form a large fireball and/or flash due to the fire retarded nature of carbon monoxide and/or carbon dioxide. FIG. 27 represents stage 2706 in which the projectile 1910 travels to the target and a user is prepared to take another shot. As can be seen, the suppressor 105 is filled with combustion gas 1830, thus the chance of a large fireball and/or flash for subsequent shots is mitigated due to the oxygen being forced out of the suppressor 105 and replaced with fire retardant carbon monoxide and/or carbon dioxide.

Glossary of Terms

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's dictionaries and Random House dictionaries. As used in the specification and claims, the following definitions apply to these terms and common variations thereof identified below.

"About" with reference to numerical values generally refers to plus or minus 10% of the stated value. For example, if the stated value is 4.375, then use of the term "about 4.375" generally means a range between 3.9375 and 4.8125.

"Acute" or "Acute Angle" generally refers to an angle smaller than a right angle or less than 90 degrees.

"Adhesive" generally refers to any non-metallic substance applied to one or both surfaces of two separate parts that binds them together and resists their separation. For example, an adhesive can bond both mating surfaces through specific adhesion (e.g., molecular attraction), through mechanical anchoring (e.g., by flowing into holes in porous surfaces), and/or through fusion (e.g., partial solution of both surfaces in the adhesive or its solvent vehicle). Some non-limiting examples of adhesives include liquid adhesives, film adhesives, resin adhesives, rubber adhesives, silicone-based adhesives, mastics, metal-to-metal adhesives, plastic adhesives, rubber adhesives, sprayable adhesives, and hot melt adhesives, to name just a few.

"Aftermarket Product" generally refers to one or more parts and/or accessories used in repair and/or enhancement of a product already made and sold by an Original Equipment Manufacturer (OEM). For example, aftermarket products can include spare parts, accessories, and/or components for motor vehicles.

"And/Or" generally refers to a grammatical conjunction indicating that one or more of the cases it connects may occur. For instance, it can indicate that either or both of two stated cases can occur. In general, "and/or" includes any combination of the listed collection. For example, "X, Y, and/or Z" encompasses: any one letter individually (e.g., {X}, {Y}, {Z}); any combination of two of the letters (e.g., {X, Y}, {X, Z}, {Y, Z}); and all three letters (e.g., {X, Y, Z}). Such combinations may include other unlisted elements as well.

"Axially" means here relating to or forming an axis, wherein an axis is a fixed linear reference line, in this case axis A-A shown in the drawing figures and the axis along which the parts are moved with respect to each other to connect them together.

"Baffle" generally refers to a flow-directing and/or flow obstructing device used to direct a flow of liquid and/or gas. For example, suppressors include one or more baffles configured to slow the movement of combustion gasses after a shot.

"Barrel" generally refers to a cylindric tube through which a projectile travels after a shot from a firearm. The barrel is generally made from metal and/or a metallic material. However, some barrels are made from a polymeric material, such as carbon fiber. The barrel includes a hollow interior portion known as the bore, which corresponds to a caliber and/or projectile diameter for the firearm. For example, a larger projectile (bullet) requires a larger diameter bore and a smaller projectile requires a smaller diameter bore. The diameter of the bore is configured to correspond with a diameter of the projectile. For example, the bore may range from 0.51 inches (13 mm) to 0.172 inches (4.5 mm). The bore may be smooth and/or rifled. The barrel further includes a breech end and a muzzle end. The breech end is proximal the shooter during firing and the muzzle end is distal the shooter when firing. Generally, a projectile is loaded into the barrel at the breech end and is discharged from the firearm at the muzzle end.

"Bearing" generally refers to a machine element that constrains relative motion and reduces friction between moving parts to only the desired motion, such as a rotational movement. The bearing for example can be in the form of loose ball bearings found in a cup and cone style hub. The bearing can also be in the form of a cartridge bearing where ball bearings are contained in a cartridge that is shaped like a hollow cylinder where the inner surface rotates with respect to the outer surface by the use of ball or other types of bearings.

"Central Opening" means here an aperture, gap, or hollow portion of an object or structure that occurs within the outer boundaries of the object or structure. The opening may be, but is not required, to be located in the center of the object. It may be circular or non-circular.

"Channel" generally refers to a long, narrow groove in a surface of an object.

"Couple" or "Coupled" generally refers to an indirect and/or direct connection between the identified elements, components, and/or objects. Often the manner of the coupling will be related specifically to the manner in which the two coupled elements interact.

"Fastener" generally refers to a hardware device that mechanically joins or otherwise affixes two or more objects together. By way of non-limiting examples, the fastener can include bolts, dowels, nails, nuts, pegs, pins, rivets, screws, buttons, hook and loop fasteners, and snap fasteners, to just name a few.

"Firearm" generally refers to any device that can be used to and/or converted to expel a projectile via an explosion. For example, firearms include pistols, rifles, shotguns, muzzleloaders, carbines, machine guns, sniper rifles, submachine guns, assault rifles, automatic rifles, semiautomatic rifles, flare guns, starter guns, and/or other devices. In another example, a firearm may have different actions, such as lever action, pump action, manual, semiautomatic, automatic, selective fire, single action, double action, hammer fired, and/or other actions.

"Flash Hider" generally refers to a device configured to reduce the visual signature of a firearm. For example, a flash hider disperses combustion gasses after a firearm is shot to reduce muzzle flash. Flash hiders may also be known as flash suppressors, flash guards, flash eliminators, flash cones, and/or other names.

"Frustoconical" generally refers to the shape of a frustum of a cone. In other words, frustoconical generally refers to a shape defined by the remainder of a cone or pyramid that lies between the base and a plane parallel to the base. Generally, the intersecting portion of the cone has been removed by a plane parallel to the base of the cone. This shape includes two open ends, one at the base and one at the intersecting plane.

"Housing" generally refers to a component that covers, protects, and/or supports another thing. A housing can have a unitary construction or made of multiple components. The housing can be made from the same material or a combination of different materials. The housing can include a protective cover designed to contain and/or support one or more mechanical components. Some non-limiting examples of a housing include a case, enclosure, covering, body, and shell.

"Longitudinal" generally refers to the length or lengthwise dimension of an object, rather than across.

"Metallic" generally refers to a material that includes a metal, or is predominately (50% or more by weight) a metal. A metallic substance may be a single pure metal, an alloy of two or more metals, or any other suitable combination of metals. The term may be used to refer to materials that include nonmetallic substances. For example, a metallic cable may include one or more strands of wire that are predominately copper sheathed in a polymer or other nonconductive material.

"Muzzle Flash" generally refers to the light, both visible and infrared, created by firing a firearm. Muzzle flash is generally caused by the sudden release and/or expansion of high-temperature and pressure gasses from the muzzle of the firearm after a shot.

"Original Equipment Manufacturer" or "OEM" generally refers to an organization that makes finished devices from component parts bought from other organizations that are usually sold under their own brand in a consumer or commercial market.

"Projectile" generally refers to an object propelled by the application of an external force. For example, a firearm is configured to fire projectiles in the form of bullets, shells, slugs, balls, and/or other objects.

"Suppressor" generally refers to a device for silencing, muffling, and/or diminishing the report and/or noise associated with the firing of a firearm, including any combination of parts, designed and/or redesigned, and intended for the use of assembling and/or fabricating a suppressor. Suppressors are also used for reducing recoil after a shot and/or reducing muzzle flash associated with a shot. Suppressors may also be known as cans, mufflers, silencers, and/or other names. In one example, a suppressor includes an interior portion with one or more baffles.

"Transverse" generally refers to things, axes, straight lines, planes, or geometric shapes extending in a nonparallel and/or crosswise manner relative to one another. For example, when in a transverse arrangement, lines can extend at right angles or perpendicular relative to one another, but the lines can extend at other non-straight angles as well such as at acute, obtuse, or reflex angles. For instance, transverse lines can also form angles greater than zero (0) degrees such that the lines are not parallel. When extending in a transverse manner, the lines or other things do not necessarily have to intersect one another, but they can.

It should be noted that the singular forms "a," "an," "the," and the like as used in the description and/or the claims include the plural forms unless expressly discussed otherwise. For example, if the specification and/or claims refer to "a device" or "the device", it includes one or more of such devices.

It should be noted that directional terms, such as "up," "down," "top," "bottom," "lateral," "longitudinal," "radial," "circumferential," "horizontal," "vertical," etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by the following claims are desired to be protected. All publications, patents, and patent applications cited in this specification are herein incorporated by reference as if each individual publication, patent, or patent application were specifically and individually indicated to be incorporated by reference and set forth in its entirety herein.

REFERENCE NUMBERS

100 firearm
105 suppressor
110 barrel
115 muzzle end
120 distal end
205 body
210 end cap
215 first end
220 mounting portion
225 second end
230 length
235 diameter
305 receptacle
405 bore
410 vent
605 apertures
610 vent channel
612 funnel
615 baffles
620 guide surface
625 purge channel
630 guide wall
635 cavity
705 suppressor
707 body
710 end cap
720 mounting portion
730 length
735 diameter
905 mounting plate
910 latch
915 pin
920 compensator
1025 purge channel
1205 suppressor
1207 body
1220 mounting portion
1230 length
1235 diameter
1405 nut
1410 support
1415 bearings
1420 flash hider
1425 post
1505 cutout
1625 purge channel
1806 stage
1830 combustion gas
1906 stage
1910 projectile
2006 stage
2106 stage
2206 stage
2306 stage
2406 stage
2506 stage
2510 fire-retardant zone
2606 stage
2706 stage

What is claimed is:

1. A system, comprising:

a suppressor having a series of baffles;

wherein the baffles define a bore through which a projectile travels when fired;

wherein the suppressor defines an auto purge channel;

wherein the suppressor has a mounting portion configured to mount to a barrel of a firearm configured to fire the projectile;

wherein the suppressor has an end cap located at a distal end of the suppressor opposite the mounting portion;

wherein the end cap and at least one of the baffles proximal to the end can define a cavity;

wherein the auto purge channel extends in a longitudinal direction to direct gas from the mounting portion towards the distal end;

wherein the auto purge channel is sized smaller than the bore to direct gas created from firing the projectile at a speed that is greater than a speed of the projectile when tired; and wherein the auto purge channel has guide wall at the distal end to guide the gas into the cavity ahead of the projectile to reduce muzzle flash.

2. The system of claim 1, wherein the auto purge channel enables the gas to saturate an area of the suppressor in front of the projectile.

3. The system of claim 1, wherein the auto purge channel is sized to emit a predetermined amount of the gas.

4. The system of claim 1, wherein the bore is configured to direct the projectile to travel through the gas transferred by the auto purge channel.

5. The system of claim 1, wherein the gas is carbon dioxide gas generated by combustion from a shot.

6. The system of claim 1, wherein the suppressor includes a funnel portion configured to direct the gas into the auto purge channel.

7. The system of claim 1, wherein:

the suppressor has baffle mounting locations where the baffles are mounted in the suppressor; and the auto purge channel runs adjacent to the baffle mounting locations.

8. The system of claim 1, wherein the auto purge channel runs parallel to the bore.

9. The system of claim 1, wherein the suppressor is a stacked baffle suppressor.

10. The system of claim 1, wherein the suppressor is a monocore suppressor.

11. A system, comprising:

a suppressor defining an auto purge channel to reduce muzzle flash;

wherein the suppressor has a plurality of baffles;

wherein the suppressor has an end cap located at a distal end of the suppressor;

wherein the end cap and at least one of the baffles proximal to the end cap define a cavity;

wherein the baffles define a bore through which a projectile travels when fired;

wherein at least carbon dioxide gas is created when the projectile is fired;

wherein the auto purge channel is configured to receive a portion of the gas produced when the projectile is fired; and wherein the auto purge channel is shaped to bypass the gas around at least some of the baffles to saturate the cavity with the gas in front of the projectile entering the cavity.

12. The system of claim 11, wherein the auto purge channel is sized smaller than the bore to direct the gas at a speed that is greater than a speed of the projectile when fired.

13. The system of claim 11, wherein the auto purge channel is sized to emit a predetermined amount of the gas.

14. The system of claim 11, wherein:

the suppressor has baffle mounting locations where the baffles are mounted in the suppressor; and the auto purge channel runs adjacent to the baffle mounting locations.

15. The system of claim 14, wherein the auto purge channel runs parallel to the bore.

16. The system of claim 11, wherein the auto purge channel is configured to reduce first shot fireball when firing a weapon.

17. The system of claim 11, wherein:

the auto purge channel extends in a longitudinal direction at a position away from the baffles that bypasses the gas around at least some of the baffles; and the auto purge channel is sized smaller than the bore to facilitate the gas saturating the cavity ahead of the projectile.

18. The system of claim 11, wherein:

the suppressor has a mounting portion configured to mount to a barrel of a firearm configured to fire the projectile;

the suppressor has a funnel positioned proximal the mounting portion to direct the gas into the auto purge channel; and the auto purge channel has a guide wall at the distal end to guide the gas into the cavity ahead of the projectile to reduce the muzzle flash.

19. The system of claim 1, wherein:

the auto purge channel has a uniform unobstructed shape to direct gas created from firing the projectile at a speed that is greater than a speed of the projectile when fired;

the auto purge channel has a guide wall at the distal end to guide the gas into the cavity ahead of the projectile to reduce muzzle flash;

the suppressor has a funnel positioned proximal the mounting portion to direct the gas into the auto purge channel; and the auto purge channel is isolated from the bore in the baffles from the funnel to the guide wall.

* * * * *